US012252287B2

(12) United States Patent
Westarp et al.

(10) Patent No.: US 12,252,287 B2
(45) Date of Patent: Mar. 18, 2025

(54) CLEANING APPARATUS AND METHOD FOR CLEANING

(71) Applicant: HAVER & BOECKER OHG, Oelde (DE)

(72) Inventors: Christian Westarp, Oelde (DE); Renè Mackel, Diestedde (DE)

(73) Assignee: HAVER & BOECKER OHG, Oelde (DE)

( * ) Notice: Subject to any disclaimer, the term of this patent is extended or adjusted under 35 U.S.C. 154(b) by 330 days.

(21) Appl. No.: 17/998,321

(22) PCT Filed: May 11, 2021

(86) PCT No.: PCT/EP2021/062432
§ 371 (c)(1),
(2) Date: Nov. 9, 2022

(87) PCT Pub. No.: WO2021/228823
PCT Pub. Date: Nov. 18, 2021

(65) Prior Publication Data

US 2023/0227195 A1 Jul. 20, 2023

(30) Foreign Application Priority Data

May 13, 2020 (DE) ..... 102020112995.5

(51) Int. Cl.
*B65B 55/24* (2006.01)
*B65B 1/06* (2006.01)
(Continued)

(52) U.S. Cl.
CPC ..... *B65B 55/24* (2013.01); *B65B 1/06* (2013.01); *B65B 1/28* (2013.01); *B65B 43/16* (2013.01); *B65B 43/465* (2013.01); *B65B 65/003* (2013.01)

(58) Field of Classification Search
None
See application file for complete search history.

(56) References Cited

U.S. PATENT DOCUMENTS 4,448,011 A 5/1984 Pohl
4,510,736 A 4/1985 Müller
(Continued)

FOREIGN PATENT DOCUMENTS

AU 454509 B2 10/1974
DE 102007021786 A1 11/2007
(Continued)

OTHER PUBLICATIONS

International Search Report and Written Opinion received for PCT/EP2021/062432, mailed Sep. 9, 2021.
(Continued)

*Primary Examiner* — Rita P Adhlakha
(74) *Attorney, Agent, or Firm* — Greer, Burns & Crain, Ltd

(57) ABSTRACT

A packing machine having a cleaning apparatus and a cleaning apparatus for cleaning a working section when filling bulk materials into containers, including a blowing strip having a first nozzle device and a second nozzle device through which an air stream can be guided temporarily in each case. In this case, the first and the second nozzle devices each have a fixed blowing-out direction, wherein the blowing-out directions of the first nozzle device and of the second nozzle device differ from one another. Furthermore, a control device is provided which is suitable and configured to control the first nozzle device and the second nozzle device at least temporarily in a temporally staggered manner. In a method for cleaning a working section using such a
(Continued)

cleaning apparatus, the control device controls the first nozzle device and the second nozzle device in a temporally staggered manner.

22 Claims, 16 Drawing Sheets

(51) Int. Cl.

| | |
|---|---|
| ***B65B 1/28*** | (2006.01) |
| ***B65B 43/16*** | (2006.01) |
| ***B65B 43/46*** | (2006.01) |
| ***B65B 65/00*** | (2006.01) |

(56) References Cited

U.S. PATENT DOCUMENTS

| | | | |
|---|---|---|---|
| 5,398,484 | A | 3/1995 | Kader |
| 6,401,439 | B1 | 6/2002 | Tetenborg et al. |
| 6,474,050 | B1 | 11/2002 | Tetenborg |
| 6,925,790 | B1 | 8/2005 | Krone et al. |
| 7,764,891 | B2 | 7/2010 | Du et al. |
| 7,861,499 | B2 | 1/2011 | Combrink et al. |
| 7,954,307 | B2 | 6/2011 | Paunesku et al. |
| 9,352,860 | B2 | 5/2016 | Vollenkemper et al. |
| 9,802,724 | B2 | 10/2017 | Vollenkemper |
| 11,273,942 | B2 | 3/2022 | Schütte et al. |
| 11,305,904 | B2 | 4/2022 | Gallaun et al. |
| 2019/0300216 | A1 | 10/2019 | Nakamoto |
| 2019/0375530 | A1 | 12/2019 | Mora Flores et al. |
| 2020/0062429 | A1 | 2/2020 | Felling et al. |
| 2020/0369417 | A1 | 11/2020 | Pieper et al. |

FOREIGN PATENT DOCUMENTS

| | | | |
|---|---|---|---|
| DE | 102008014489 | A1 | 9/2009 |
| DE | 102011002808 | A1 | 7/2012 |
| DE | 102013105603 | A1 | 12/2014 |
| EP | 1857369 | A2 | 11/2007 |
| EP | 2117781 | A1 | 11/2009 |
| EP | 2132095 | A1 | 12/2009 |
| EP | 3715267 | A1 | 9/2020 |
| IT | MI20121877 | A1 | 5/2014 |
| JP | 2002143794 | A | 5/2002 |

OTHER PUBLICATIONS

German Search Report received for 102020112995.5, dated Mar. 25, 2021.

CLEANING APPARATUS AND METHOD FOR CLEANING

BACKGROUND

The present invention relates to a cleaning apparatus, in particular for cleaning a working section when filling bulk materials into containers, comprising at least one blowing strip having at least one first nozzle device and at least one second nozzle device through which at least one air stream can be guided in each case, at least temporarily. The present invention additionally relates to a method for cleaning a working section using such a cleaning apparatus.

Cleaning with air or with compressed air or blowing air out of nozzles is used in many areas and can in particular be used to free a working area from dust or other particles.

For example, when filling bulk materials into containers, in particular for filling pourable and/or free-flowing products into bags, it can be appropriate to remove excess or trickling-down product at various locations in the filling process. Here also cleaning with air has become known.

After filling a bag, depending on the configuration and application, the bag walls are welded together to reliably close the bag. In order that a secure, reliable and tight welded seam can be produced here, a cleaning of the area to be welded which is frequently contaminated by trickling-down product frequently takes place.

Various cleaning methods and apparatus have become known here. For example, EP 2 015 997 A1 describes a blowing strip as head seam cleaning, which is configured as an oscillating nozzle so that a moving air stream frees the area to be welded from interfering product.

The cleaning is accomplished reliably and usually better than, for example, with a stationary air stream. Due to the mobility of the blowing strip, it is specifically achieved that the bag mouth edge above the closed clamping jaws is opened by the acting air jet so that the air jet impinges upon the inner surfaces, with the result that the adhering dust or dirt particles are removed. In this case, by changing the air jet the layers of the side folds are separated from one another so that this area is also cleaned. The individual film layers are as it were successively opened by the oscillating air stream and cleaned by the air stream thus penetrating. A disadvantage with such a configuration however is that moving components are constructively complex and high-maintenance as well as expensive.

DE 10 2011 002 808 A1 discloses a band blower device for a grinding unit. In this case, the blower device comprises a plurality of rigidly arranged nozzles by means of which a grinding band can be cleaned. In this case, for optimal cleaning of the grinding band the nozzles are each aligned transversely to the circulating direction of the grinding band. For a cleaning according to the invention however, no advantage is achieved here compared with other rigidly arranged nozzles from the prior art.

It is therefore the object of the present invention to provide a reliable cleaning by means of a moving air stream without using moving components, which is particular advantageous in explosion protection areas.

SUMMARY

The cleaning apparatus according to the invention is suitable for cleaning a working section, in particular for cleaning a working section when filling bulk materials into containers or bags, in particular for cleaning the area of a subsequent bag seam. In this case, the cleaning device comprises at least one blowing strip having at least one first nozzle device and at least one second nozzle device through which at least one air stream can be guided in each case at least temporarily. Furthermore, the first nozzle device has a fixed blowing-out direction, wherein the second nozzle device also has a fixed blowing-out direction. In this case, the blowing-out directions of the first nozzle device and the second nozzle device differ from one another. Furthermore, at least one control device is provided which is suitable and configured to control the at least one first nozzle device and the at least one second nozzle device at least temporarily in a temporally staggered manner.

The cleaning device according to the invention thus provides a cleaning apparatus which can clean a working area or working section by means of air or any gaseous fluid. In this case, a working section can be freed in particular from dust, bulk material, particles or free-flowing product, whereby dust or bulk material or particles are blown away by the air streams or fluid streams applied by the nozzle devices.

According to the present application, a nozzle device can be provided by any known and expediently usable type of nozzle or comprise such a nozzle. A nozzle device can, for example, also be provided by a simple opening or hole or comprise an opening or hole through which an air stream or fluid stream can escape. In this case, such an opening can in particular be considered to be slit-like so that with such an elongate nozzle device longer sections can also be cleaned in one piece with air.

The cleaning apparatus according to the invention can be used in many ways. In particular, the cleaning apparatus can be used for a so-called head seam cleaning or bag seam cleaning. The two terms describe the cleaning of a bag section when filling bulk materials into containers, in particular into bags, preferably into film bags before closing a bag after filling. In this case, after filling at least two film walls are placed on top of one another and welded together or joined together in a different manner. In order that a clean, reliable and tight seam is achieved when closing the bag, this area is cleaned before welding or closing and in particular freed from product trickling down from the filling nozzle and/or adhering to this.

In order to produce a moving air stream as far as possible or simulate the air stream of a moving nozzle, whereby a particularly reliable cleaning of the working section is achieved, different blowing-out directions of the first and the second nozzle devices are provided which are controlled differently. In this case, the blowing-out directions differ in particular at least slightly.

In this case, the nozzle devices are preferably arranged and controlled in such a manner that, when filling film bags, the film layers lying on top of one another after filling, which are joined together subsequently to close the bag, are bent to and fro and thus, as it were opened or blown apart so that the area between the individual film layers is cleaned. Thus, the area of the subsequent bag seam or head seam can be effectively cleaned.

For this purpose, the individual nozzle devices preferably blow transversely or at least obliquely towards the upper bag edge in order to bend this to the side. By changing the blowing direction, the bag edge preferably bends back again and thus opens, which has the result that the surfaces between the film layers are released and cleaned. A particularly good welding of the bag layers without weak points due to contaminants can thus be achieved.

Depending on the configuration, the blowing strip with the nozzle devices can be produced by holes or the like by mechanical machining. However, it is particularly preferred and advantageous that such a blowing strip is provided by a 3D printed part. More complex air supplies for providing different blowing-out directions can thus be provided particular simply in one component.

The cleaning apparatus according to the invention offers many advantages. A considerable advantage is that due to the different blowing-out directions of the first and the second nozzle device and depending on the configuration of each further nozzle device and the temporally staggered or different control of the nozzle devices via a component with static nozzle devices or nozzle, inter alia the air movement of a moving nozzle of the type described initially can be simulated. Thus, an effective cleaning of a working section can be ensured without needing to use moving parts which are more expensive to produce and maintain.

In particular, it is achieved that, for example, when cleaning the bag mouth edge before closing or welding a filled bag, due to the moving air stream the superimposed bag walls or film layers are opened by the acting air jet so that the air jet impinges upon the inner surfaces with the result that the adhering dust or dirt particles are removed. By varying the air jet preferably with a suitable configuration of the bag, the layers of the side gussets are separated from one another so that this area is also cleaned. The individual film layers are opened quasi successively by the moving or oscillating air stream and cleaned by the thus penetrating air stream.

Additionally, in addition to simulating a simple oscillating movement of an air stream, as a result of the configuration according to the invention, more complex air streams can be produced in simple and/or complex wave movements over the section to be cleaned.

Preferably at least two first nozzle devices and at least two second nozzle devices are provided, wherein at least one first nozzle device and at least one second nozzle device is controllable temporarily in a temporally staggered manner. Depending on the configuration, preferably groups of identical nozzle devices and/or groups of different nozzle devices can be controlled in a temporally staggered manner.

Preferably the first and the second nozzle device have separate and/or common air supplies. In such a design the control device then in particular controls the air supply to the different air supplies in order to output an at least temporarily temporally offset air stream through the first and the second nozzle device. If more than two different nozzle devices are provided, all the nozzle devices preferably have separate air supplies. If a plurality of nozzle devices are provided from the first nozzle device, the second nozzle device and each further nozzle device, the respectively identical nozzle devices can be connected to the same air supply. In this case, for example, such air supplies can be produced by holes in the blowing strip, wherein, for example, a horizontal channel provides an air distribution along the component, wherein holes substantially transverse thereto provide the nozzle device. Alternatively in preferred configurations a blowing strip having an in particular complex air supply can also be fabricated by a 3D printed part. If different nozzle devices are addressed jointly as a group or supplied with air, separate air supplies can also be provided for the groups so that different types of nozzle devices have a common air supply.

In other expedient configurations, the first nozzle device [and] the second nozzle device have a common air supply, wherein the first and/or the second nozzle device then preferably comprises at least one closure element in order to control the air stream which can be guided through the nozzle devices in a temporally staggered manner. This variant can also be used advantageously when, in addition to the first nozzle device and the second nozzle device, at least one further nozzle device is provided. With this type of air control, the control of the nozzle devices is expediently accomplished via a so-called common rail.

Particularly preferably at least a third nozzle device is provided which has a fixed blowing-out direction, wherein the blowing-out directions of the first nozzle device, the second nozzle device and/or the third nozzle device differ from one another. In particular, all the blowing-out directions of the individual nozzle devices or types of nozzle devices differ from one another. Depending on the configuration, arbitrary many further nozzle devices having different blowing-out directions can be provided in addition to the first, second and third nozzle devices.

In preferred further developments, at least two of the blowing-out directions or the air streams or the fluid streams from the corresponding nozzle devices intersect at a point or focal point and/or in a line or focal line. In this case, this point or the line lies in particular in the region of the upper bag edge so that due to the temporally staggered control of the nozzle devices, the bag layers to be welded subsequently are opened or blown apart since due to the bending the film layers are shifted towards one another and separated so that the area between the bag layers is also cleaned before closing.

In expedient further developments, in each case a plurality of nozzle devices of first, second and/or third nozzle devices is provided which are arranged in each case in rows on the blowing strip. If more than first, second and third nozzle devices are provided, this configuration can be further developed as required by providing further rows or also individually arranged further nozzle devices. By arranging the nozzle devices in rows, an effective cleaning can be accomplished even over a longer or elongate working section. If several blowing strips are provided which are arranged next to one another or behind one another, one or more rows of nozzle devices can provided on each blowing strip.

In expedient further developments, nozzle devices from different rows can be supplied with air via a common air supply. Depending on the configuration, a type of zig-zag pattern of active nozzles can be produced over the blowing strip. Such a complex configuration with in some cases highly complex air guides and connections of nozzle devices for common control can be accomplished in particular when the blowing strip was produced as a 3D part.

Preferably the nozzle devices of at least one row of nozzle devices are arranged offset with respect to the nozzle devices of at least another row of nozzle devices. Depending on the configuration, an effective cleaning can thus be accomplished by the offset arrangement of the nozzle devices. However, other arrangements can expediently also be used. In particular, it is advantageous if the air streams of the individual nozzle devices meet or would meet at an imaginary focal point since these are preferably successively supplied with air, wherein the distance between the nozzle devices and the working section or the bag gives the angle of inclination of the air nozzles. In this case, in particular when cleaning the area of a subsequent bag seam or head seam, the focal point preferably lies somewhat below the upper film edges.

Particularly preferably a row of first nozzle devices is arranged between the rows of second and third nozzle devices, wherein the alignment of the first nozzle device is aligned substantially vertically downwards and wherein the rows of the second and third nozzle device are arranged on opposite sides of the first nozzle devices. In this case, the blowing-out direction of the second and third nozzle devices is provided to be inclined in each case at least slightly in the direction of the first nozzle device. In such a configuration the row of first nozzle devices is arranged in particular approximately centrally above the working area or working section.

Preferably at least two blowing strips are provided which are arranged adjacent to one another. In such a configuration it is in particular provided in the case of longer or elongate working sections that the blowing direction are provided in series, i.e. preferably directly follow one after the other in the longitudinal extension. Depending on the configuration however, preferably a plurality of blowing strips can be arranged differently to one another and in particular provided not directly adjacent to one another.

In expedient further developments, the nozzle devices of the individual blowing strips are controllable differently. In this case, the different blowing strips preferably each have separate air supplies. It is thus possible that not only the individual rows of the individual nozzle devices can be controlled separately from one another but in addition, also the rows of one type of nozzle device via its division into individual blowing strips. Thus, for example, in one preferred embodiment, a transverse division of the nozzle devices into three rows can be accomplished, wherein for example, three blowing strips can be provided which divide the entire longitudinal extension of the working section to be cleaned into three areas which can be controlled differently. Thus, a type of wave motion of the air stream can be accomplished longitudinally and transversely over the working section. As a result, a particularly effective simulation and/or further development of an oscillating or moving nozzle can be simulated and a particularly suitable cleaning performance can be achieved. Depending on the configuration, however, the nozzle devices of the individual blowing strips can also be supplied simultaneously with air.

Preferably at least one suction device is provided. The particle stream swirled up by the blowing strip or the blown-up bulk material or other particles can be extracted by means of such a suction device so that no large-area contamination occurs.

It is particularly preferred if at least one housing device is provided which in particular substantially completely or completely surrounds the blowing strip. By shielding the blowing strip and in particular also the working section, particularly clean work can be ensured.

To this end, in particular, the housing device is in operative connection with the suction device. Then, depending on the configuration it is preferably possible to enable an almost dust-free cleaning of the working section, in particular of the head seam area of bags before closure by means of an in particular hermetically sealed housing device.

In order to bring a container in contact with the cleaning device or in contact with the blowing strip, in expedient further developments the housing device can comprise at least one housing element which is pivotable at least in sections. Such a pivotable housing element or such a flap in particular forms a cavity with an opposite fixed flap part which can also be arranged to be movable depending on the configuration, which cavity surrounds the blowing strip and the working section and preferably largely hermetically seals this. The air stream is in particular dimensioned so that at least the amount of blown air from the blowing strip is again extracted with the dissolved product particles and preferably at least a low vacuum is formed. By this means, explosion protection, in particular dust explosion protection can be achieved which once again increases the area of application of the cleaning device according to the invention.

Particularly preferably the length of the blowing strip is adapted to the length of a working section to be cleaned. In this case, a corresponding length of a working section can also be achieved in particular by arranging a plurality of blowing strips in rows.

The packing machine according to the invention for filling product and in particular bulk materials into bags comprises at least one cleaning device such as has been described previously.

The packing machine according to the invention also offers the advantages described previously for the cleaning apparatus. In particular, a reliable bag closure can be ensured since the cleaning apparatus ensures a reliable cleaning of the bag sections to be closed.

The method according to the invention is suitable for cleaning a working section or working area, in particular for cleaning a working section when filling bulk materials into containers or bags, in particular for cleaning the area of a subsequent bag seam, wherein a cleaning apparatus such as has been described previously is used for this purpose. In this case, the control device controls the first nozzle device and the second nozzle device at least temporarily in a temporally staggered manner.

In this case, the nozzle devices are preferably arranged in such a manner and controlled in such a manner that, when filling film bags, the film layers resting on one another after filling, which are subsequently to be joined together to close the bag, are opened or blown apart so that the area between the individual film layers is cleaned. Thus, the area of the subsequent bag seam or head seam can be effectively cleaned.

To this end, the individual nozzle devices preferably blow transversely or at least obliquely towards the upper bag edge in order to bend this to the side. As a result of changing the blowing direction, the bag edge preferably bends back again and thus opens so that the areas between the film layers are released and are accessible for the air stream and thus cleaned. Thus, a particularly good welding of the bag layers can be achieved without weak points due to contaminants.

The method according to the invention also offers the advantages such as have already been described for the cleaning apparatus. In particular, due to the temporally staggered control of the nozzle devices despite the static configuration of the nozzle devices a moving air stream is produced.

Preferably the suction device is operated at least temporarily. Thus, swirled up product or swirled up particles can thus be extracted by the suction device so that a particularly clean working mode can be ensured.

Particularly preferably the blowing strip is arranged in a housing device, wherein the suction device extracts at least temporarily at least in sections inside the housing device. In this case, the housing device preferably comprises as already stated previously a pivotable flap so that access of the container or bag to the housing device is provided. The flap forms a cavity with an opposite fixed or movable flap part which preferably in particular hermetically seals the blowing strip and the working section to be cleaned. Thus, an air stream can preferably be dimensioned so that at least the amount or air or amount of fluid blown out by the nozzle devices can be extracted, wherein in particular, at least slightly more is extracted so that a low vacuum is produced so that explosion protection is ensured.

In expedient further developments the nozzle device are arranged in rows and/or several blowing strips are arranged in a row or consecutively, wherein the control device acts upon or supplies the nozzle devices with air in such a manner that a wave-like air stream emerges along the working area or working section to be cleaned. Thus, a particularly suitable cleaning can be produced by a moving air stream which is made possible by means of a special control of the nozzle devices by means of a static component.

Further advantages and features of the present invention are obtained from the exemplary embodiment, which is explained hereinafter with reference to the appended figures.

DETAILED DESCRIPTION

Figure 1:
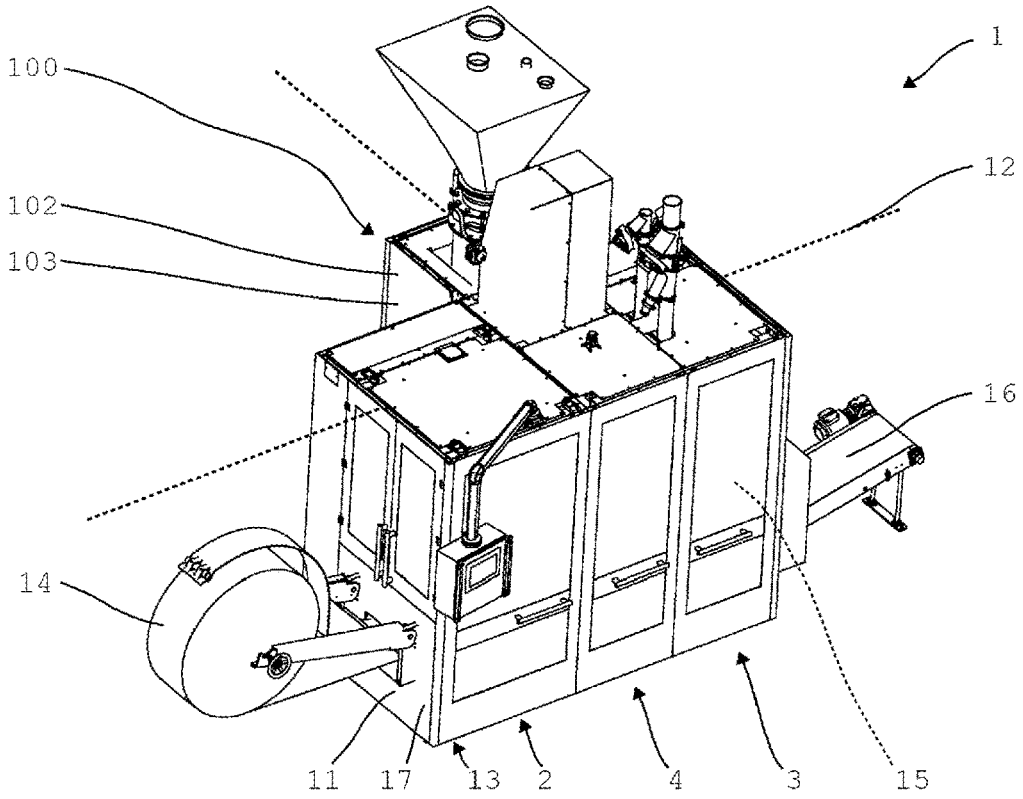
FIG. 1 shows a purely schematic diagram of an exemplary embodiment of a packing machine according to the invention in a perspective view.

FIG. 1 shows a packing machine 1 according to the invention in a perspective view. In this case, the packing machine 1 in the exemplary embodiment shown here comprises a bag supply 2, a bag removal 3 and an interposed transfer device 4. The bag supply 2, the bag removal 3 and the transfer device 4 are in this case arranged in a line 12.

A filling module 100 is provided, pulled out of line 12 and arranged in the exemplary embodiment shown here next to the transfer device 4. In the exemplary embodiment shown here, empty bags from the bag supply 2 are fed to the filling module 100 by means of the transfer device 4. The bag thus supplied to the filling module 100 is attached to the filling nozzle 101 of the filling module 100 and filled and guided by the transfer device 4 back into the line 12 and fed to the bag removal 3.

By arranging the filling module 100 next to the line or pulling out from the line, almost any filling module 100 can be used together with the modules or assemblies of the packing machine 1 arranged in the line 12. In particular, standard modules can also be used so that no special configuration of a filling module 100 must be provided for the packing machine according to the invention, preferably modules for filling open bags of any filling technology.

In the exemplary embodiment shown here, the packing machine 1 is provided encapsulated, for which the individual assemblies or modules are provided in housing devices 11, 102. In this case, in the exemplary embodiment shown here, the assemblies arranged in line 12, namely the bag supply 2, the bag removal 3 and the transfer device 4 are provided in a common housing device 11. In the exemplary embodiment shown here, the filling module 10 is provided in its own housing device 102.

By arranging the individual assemblies or modules in housing devices 11, 102, it is possible to hermetically seal off the filling process depending on the configuration so that hazardous or sensitive substances can also be filled by means of the packing machine 1. In particular, in the packing machine 1 or in the housing devices 11, 102 a vacuum can also be applied or a suction can take place so that product which escapes during filling does not escape into the environment but can be safely disposed of or even recycled.

In the exemplary embodiment shown here the bag supply 2 also comprises a bag production 13, wherein bags are produced for this purpose starting from a film supply 14 and made available to the transfer device 4.

In the exemplary embodiment shown here the bag removal 3 comprises a closing device 15, by means of which the filled and still open bags can be closed and a conveyor belt 16 for the removal of the filled and closed bags.

Since the bag supply 2, the bag removal 3 and the transfer device are arranged in a line 12 and the filling module 100 is arranged pulled out of this line 112, this results in a T-shaped arrangement of the packing machine 1 according to the invention.

As already mentioned previously, this offers many advantages. An advantage is that by juxtaposing the filling module 100 or by pulling out the filling module 100 from the line 12, almost any (standard) filling module can be used. As a result, on the one hand, existing filling modules 100 can be used. On the other hand, due to the juxtaposition a filling module can also be changed or exchanged quickly without too much effort. In known inline systems, i.e., systems in which everything is arranged in a line, for reasons of space it can be difficult to arrange the filling technology, in particular the air filling module 105 with pressure chamber 106 shown in the exemplary embodiment, in line. In addition, operability or maintainability would be more difficult.

Another advantage is that due to the T-shaped configuration or arrangement of the packing machine a particularly compact design is possible.

Figure 2:
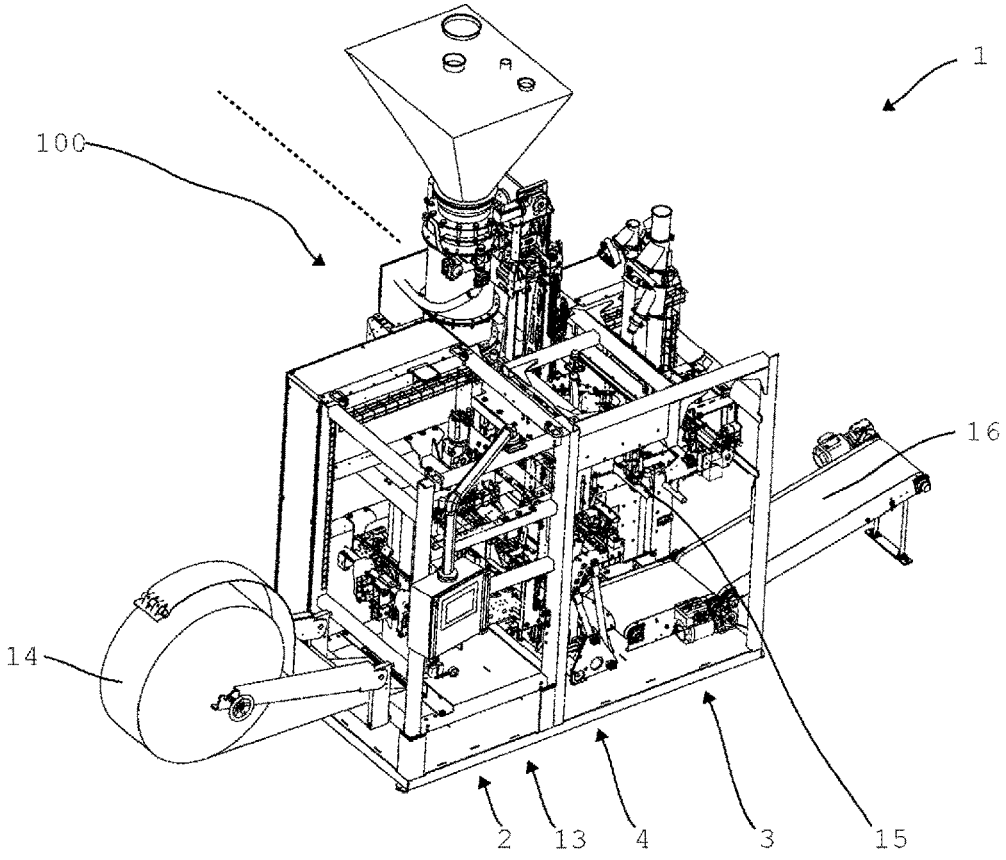
FIG. 2 shows a further purely schematic diagram of an exemplary embodiment of a packing machine according to the invention in a perspective view.
Figure 3:
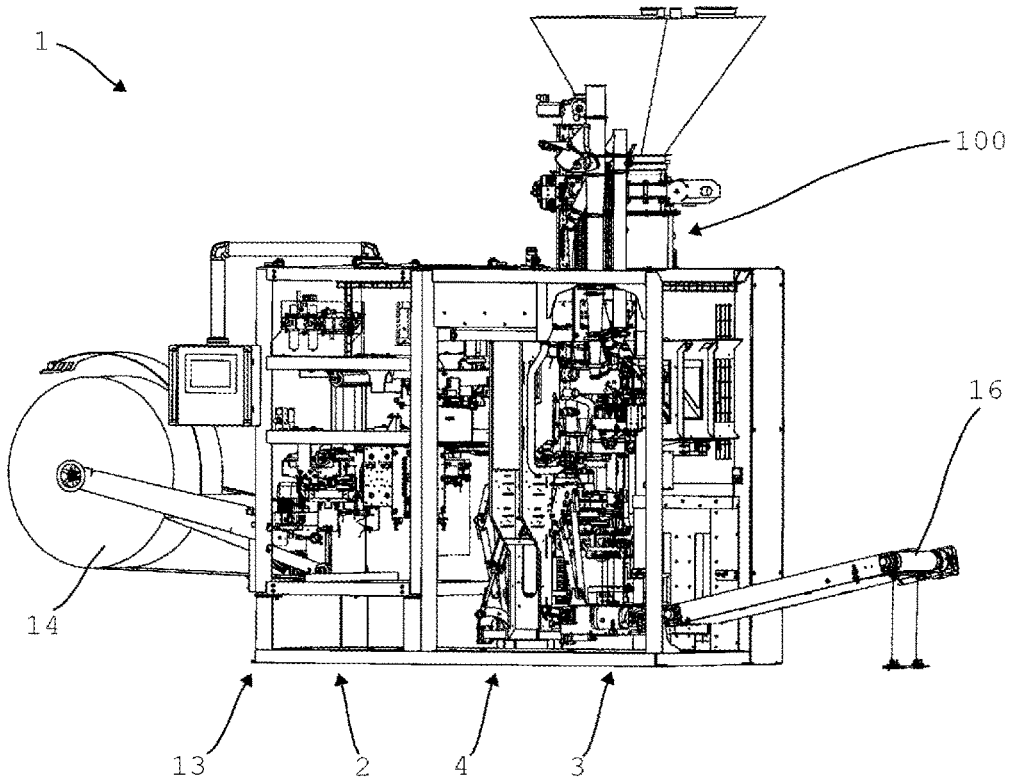
FIG. 3 shows a next purely schematic diagram of an exemplary embodiment of a packing machine according to the invention in a perspective view.
Figure 4:
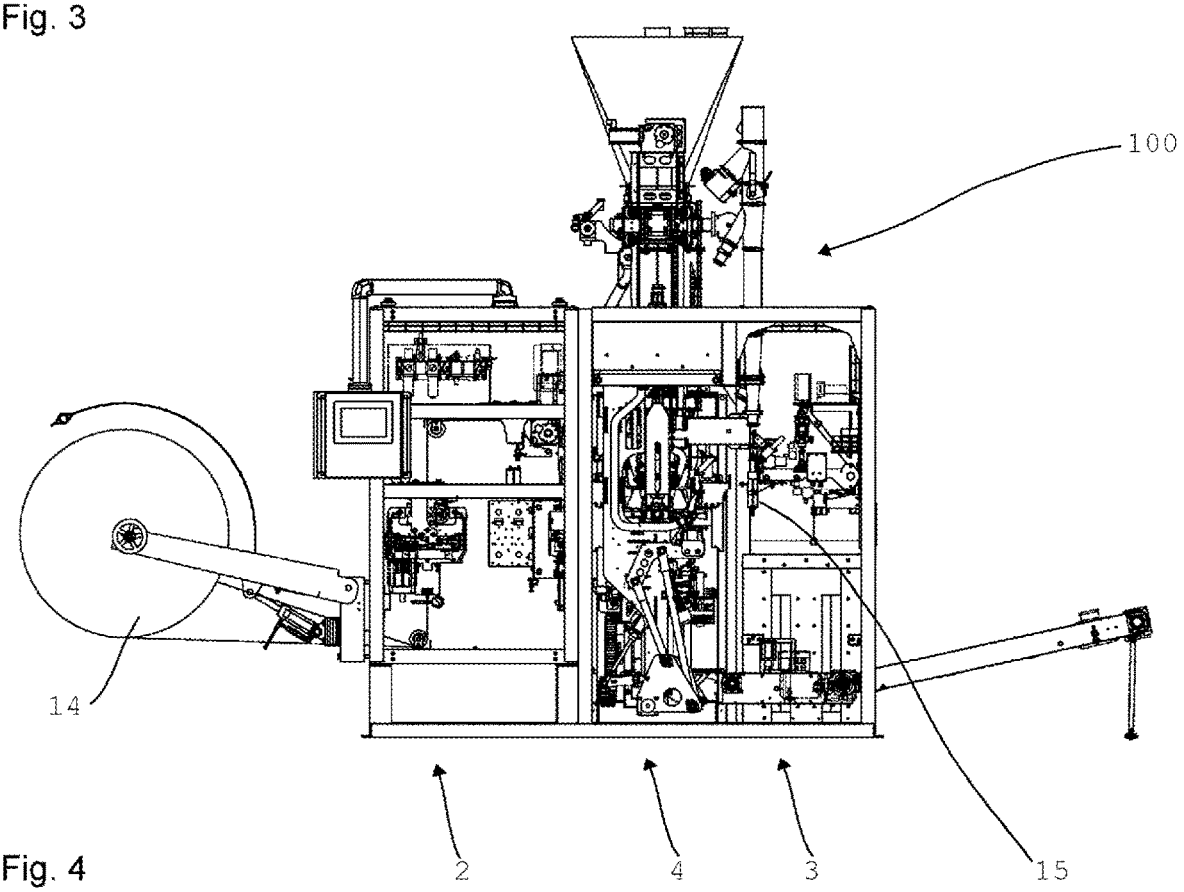
FIG. 4 shows a purely schematic diagram of an exemplary embodiment of a packing machine according to the invention in a view from the front.

For better illustration of the packing machine 1, FIGS. 2 to 4 show two perspective views and a front view of the packing machine 1, wherein in the housing devices 11, 102, the housing covers 17, 103 are not shown to provide overview views of the interior of the packing machine 1 or of the various modules or assemblies.

Figure 5:
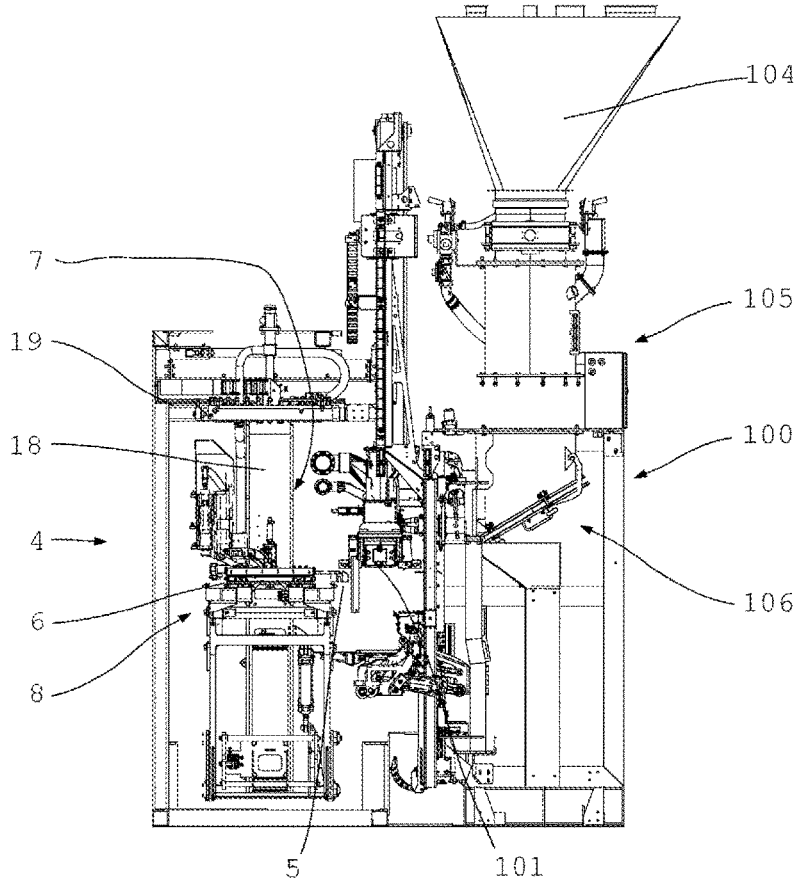
FIG. 5 shows a purely schematic diagram of an exemplary embodiment of a packing machine according to the invention in a view from the side of the bag removal.
Figure 6:
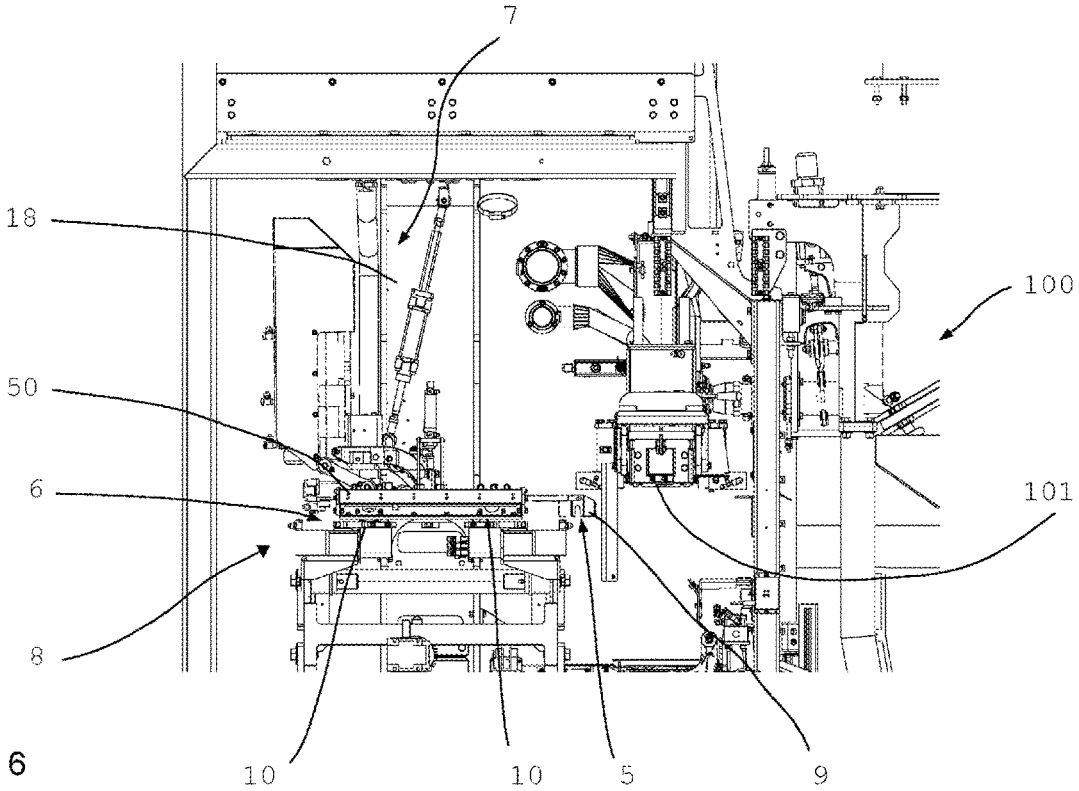
FIG. 6 shows a further purely schematic diagram of an exemplary embodiment of a packing machine according to the invention in a view from the side of the bag removal.

In FIGS. 5 and 6, the view of the transfer device 4 from the side of the bag removal 3 is shown once in an overview view and once in an enlarged diagram.

In this view, it can be seen that the filling module 100 is provided or arranged next to the transfer device 4, wherein the filling nozzle 101 of the filling module 100 can also be identified in this view. Here the inlet hopper 104 of the filling module 100 can also be seen, which is connected to a silo for product to be filled, which is located thereabove but not shown. In this case, product is fed via the inlet hopper 104 into the pressure chamber 106 inside the filling module 100 or here the air filling module 105 to the filling nozzle 101.

In this view it can be seen that the transfer device comprises a first gripper device 5 and a second gripper device 6, which are mounted on different sides 7, 8 of the transfer device 4 or on a base body 18 of the transfer device 4.

It is shown here that the base body 18 of the transfer device 4 is configured in a pillar-like manner here and is provided in a suspended manner in the exemplary embodiment shown here. In the exemplary embodiment shown, the base body 18 is suspended on rails 19, whereby the base body 19 with the gripper devices 5, 6 can be pulled out in this view to the left from the line 12. This displaceability of transfer device 4 will be shown and described in more detail later.

In addition to the displaceability of the transfer device 4 or the base body 18 of the transfer device 4, the base body 18 can also be rotated by 90° back and forth in the exemplary embodiment shown here. By turning back and forth the base body 18 of the transfer device 4 and by arranging the first gripper device 5 on one side 7 of the base body 18 and arranging the second gripper device 6 on the side 8 of the base body 18, by turning the base body 18 back and forth through 90° a bag from the bag supply 2 can be fed by means of the transfer device 4 out from line 12 to the filling module 100 or the filling nozzle 101. When the base body 18 or the transfer device 4 turns back, the second gripper device 6 comes in contact with the now filled bag at the filling nozzle 101 and can pick this up and can be guided back into the line 12 by turning forwards or re-turning the base body 18 and fed to the bag removal.

In the enlargement in FIG. 6 the first gripper device 5 and the second gripper device 6 can be identified on different sides 7, 8 of the base body 18 of the transfer device 4. One of the two gripper arms 9 of the first gripper device 5 can also be identified here.

Figure 7:
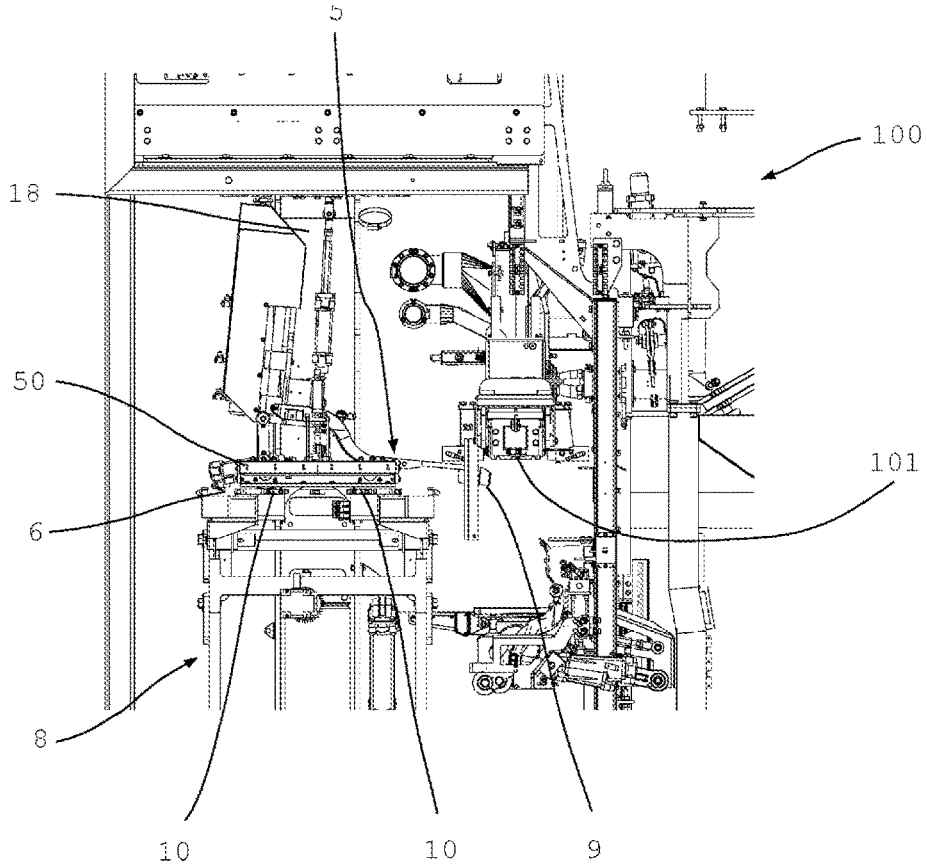
FIG. 7 shows a next purely schematic diagram of an exemplary embodiment of a packing machine according to the invention in a view from the side of the bag removal.
Figure 8:
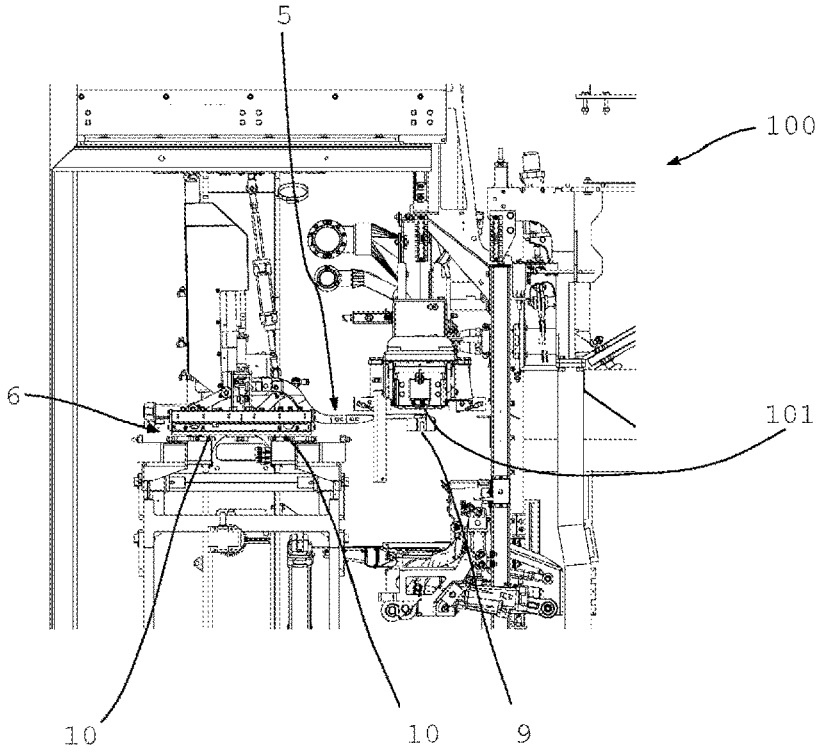
FIG. 8 shows another purely schematic diagram of an exemplary embodiment of a packing machine according to the invention in a view from the side of the bag removal.

As can be seen in more detail in the following figures, in the exemplary embodiment shown here the gripper device 5 comprises two gripper arms 9 which can be moved relative to each other so that they serve as a kind of spreader. Thus, it is possible that the gripper arms 9 of the first gripper device 5 pick up an open bag from the bag supply 2 or the bag production and attach this to the filling nozzle 101. For this purpose, the first gripper device 5 or for this purpose, the gripper arms 9 in the exemplary embodiment shown here can also be displaced forwards and pulled back again, which is shown purely schematically in FIGS. 7 and 8.

Figure 9:
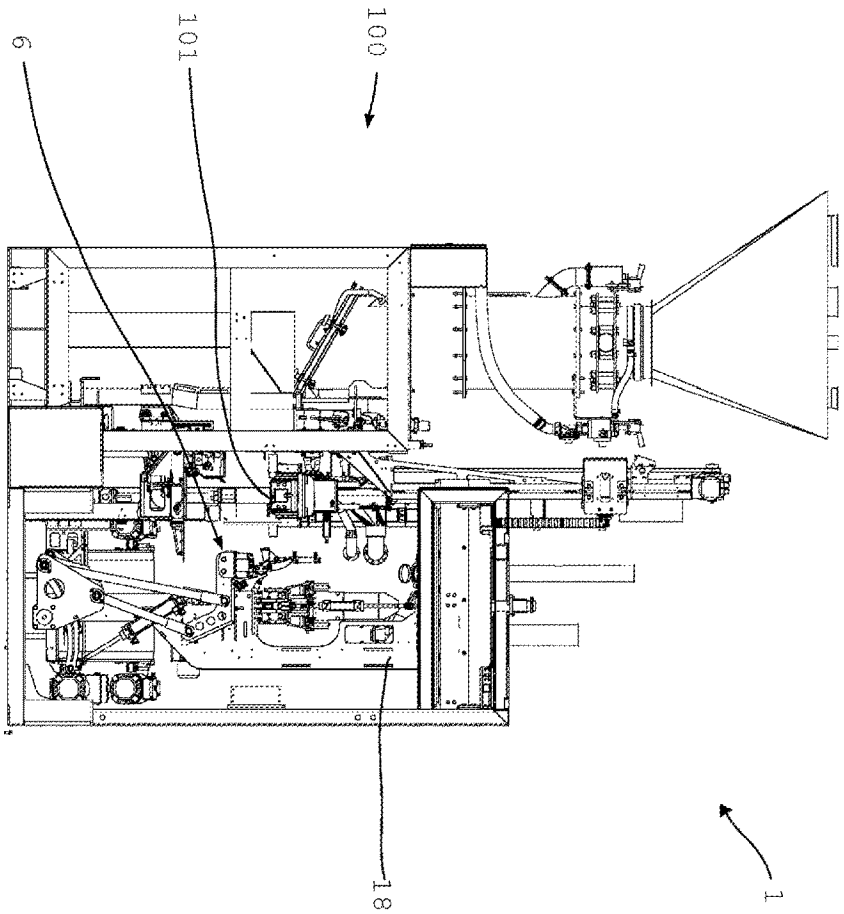
FIG. 9 shows a purely schematic diagram of an exemplary embodiment of a packing machine according to the invention in a view from the side of the bag supply.

FIG. 9 shows purely schematically the view of the transfer device 4 and the filling module 100 from the direction of the bag supply 2. In this case, the base body 18 of the transfer device 4 is rotated in such a manner that the second gripper device 6 is aligned in the direction of the filling nozzle 101 of the filling module 100. In this position, the first gripper device 5 is aligned in such a manner that it can receive an empty bag from the bag supply 2.

Figure 10:
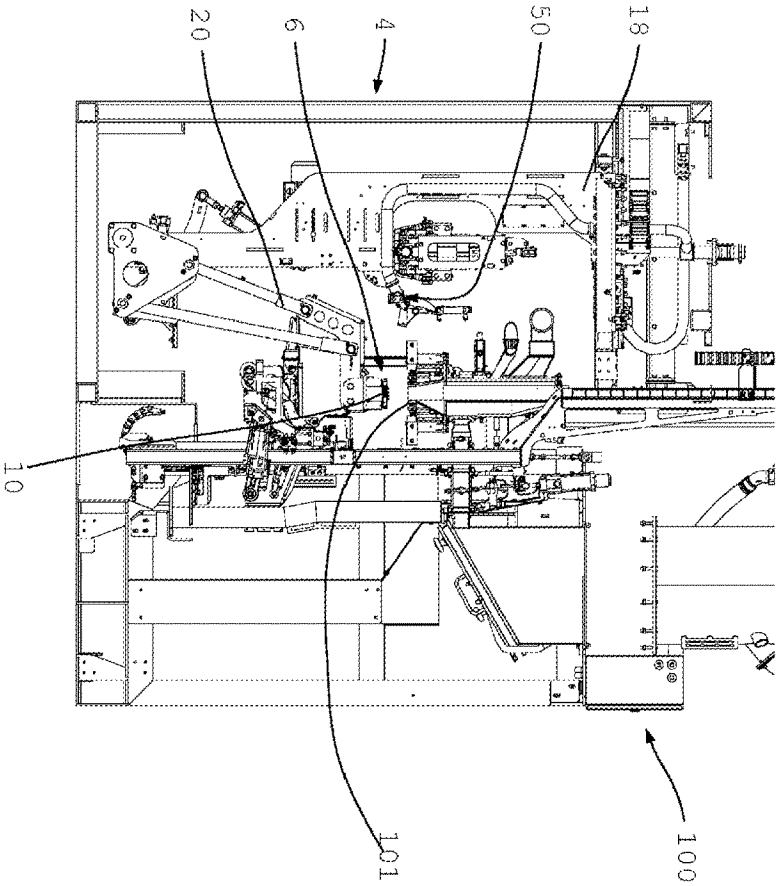
FIG. 10 shows a purely schematic diagram of an exemplary embodiment of a packing machine according to the invention in a view from the side of the bag removal.

FIG. 10 shows a purely schematic view of the transfer device 4 and the filling module 100 from the side of the bag removal 3.

Here it can be seen that the second gripper device 6 is provided to be displaceable so that the second gripper device 6 in the exemplary embodiment shown can be pivoted or displaced forwards via a parallelogram-like structure 20 in the direction of the filling nozzle 101. Thus, the clamping devices 10 of the second gripper device 6 can compress the still open bag walls of the filled bag and then displace the bag back in the direction of the base body 18.

Subsequently, the base body 18 can be rotated clockwise by 90° here so that the full bag can be displaced back into the line 12 and then fed to the bag removal. At the same time, during the removal of the full bag by the second gripper device 6, a new empty bag can be picked up by the first gripper device 5. When turning the full bag forwards into the line 12, a new empty bag is then simultaneously moved out of line 12 and fed to the filling nozzle 101.

In FIG. 10 it can also be seen that a cleaning device according to the invention 50 is provided above the second gripper device 6, which is explained in detail in the subsequent figures.

Figure 11:
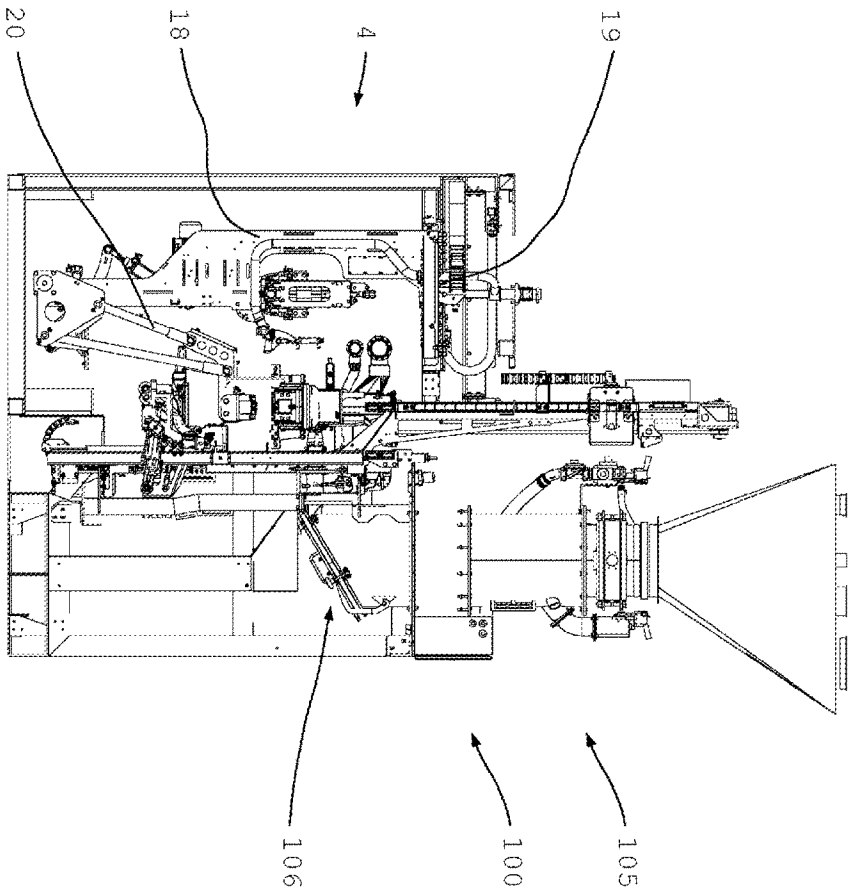
FIG. 11 shows a further purely schematic diagram of an exemplary embodiment of a packing machine according to the invention in a view from the side of the bag removal.
Figure 12:
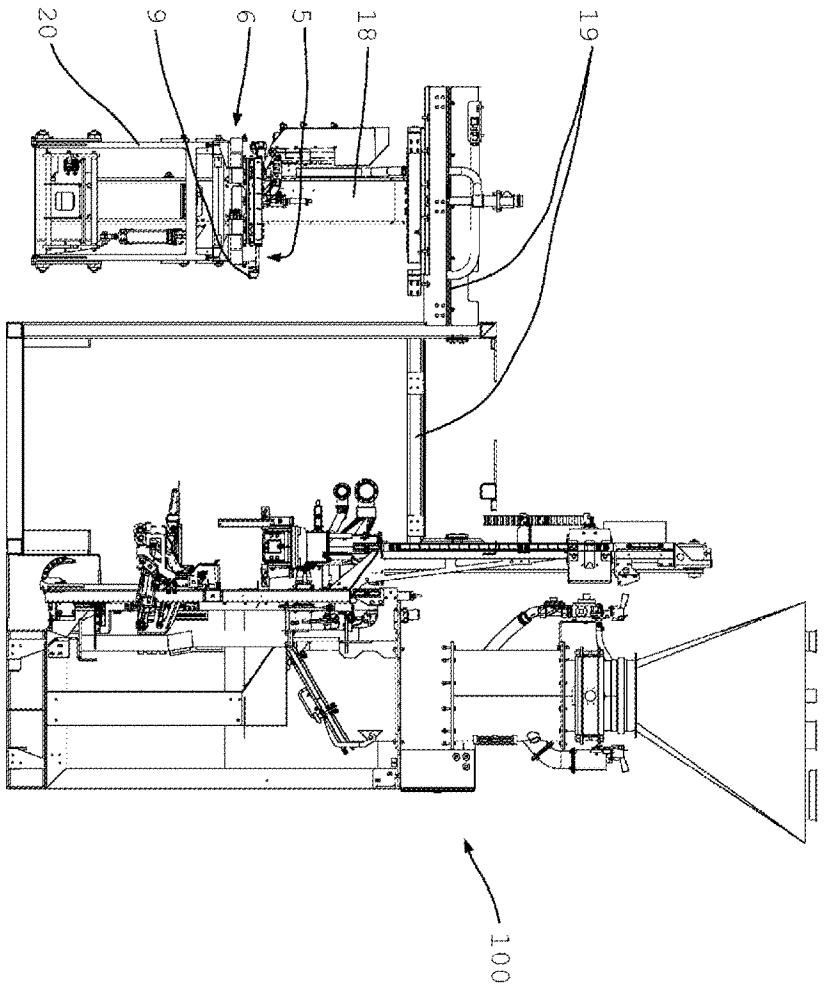
FIG. 12 shows the view according to FIG. 11 with pulled-out transfer device.

FIGS. 11 and 12 show purely schematically once again a side view of the packing machine 1 or of the transfer device 4 and the filling module 100 from the direction of the bag removal 3. When this view is compared, it can be seen that the transfer device 4 or the base body 18 together with the gripper devices 5, 6 fastened thereon is configured to be movable or extendable.

For this purpose, as already stated in the exemplary embodiment shown here, the base body 18 is suspended in an upper region and displaceable via a rail 19 or a rail system 19. Other technical components or components for displacing the base body 18 can be used analogously.

Since in the exemplary embodiment shown here, the transfer device 4 or the base body 18 of the transfer device 4 can be pulled out transversely to the line 12, for example, a sufficient space for maintenance staff is provided for maintenance of the packing machine 1.

Thus, in the extended state of the base body 18 in the exemplary embodiment shown here it is in particular possible to comfortably reach all the assemblies of the packing machine 1. In particular, the filling module 100 can be reached from the side of the filling nozzle 101. However, the bag supply 2, the bag removal and also the otherwise inaccessible side of the transfer device can be maintained and/or repaired.

Figure 13:
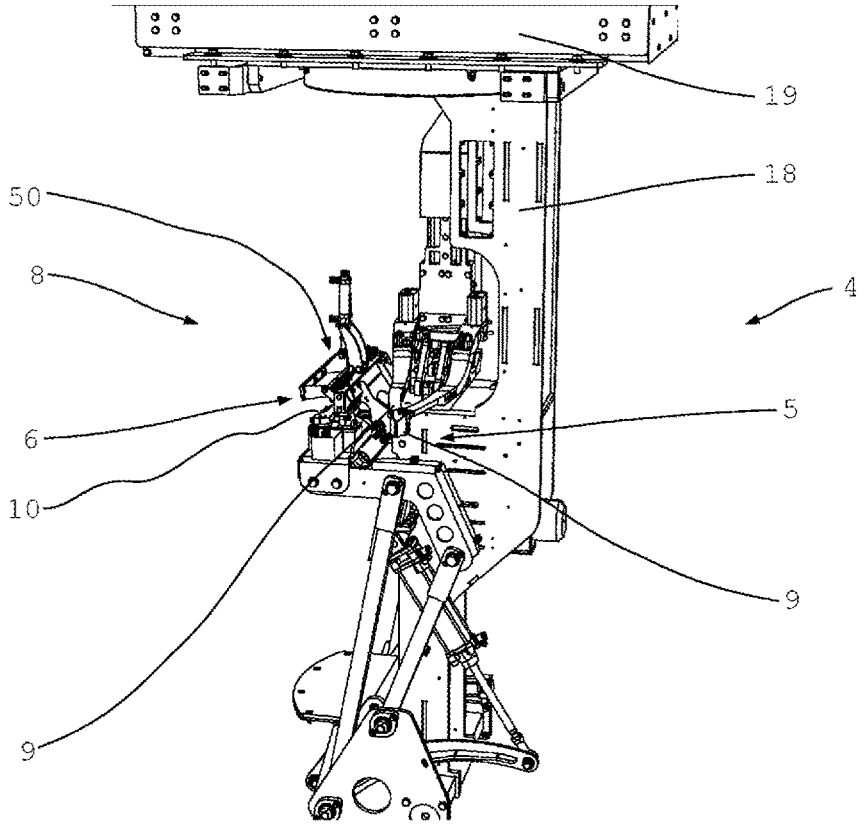
FIG. 13 shows a purely schematic diagram of an exemplary embodiment of a transfer device.
Figure 14:
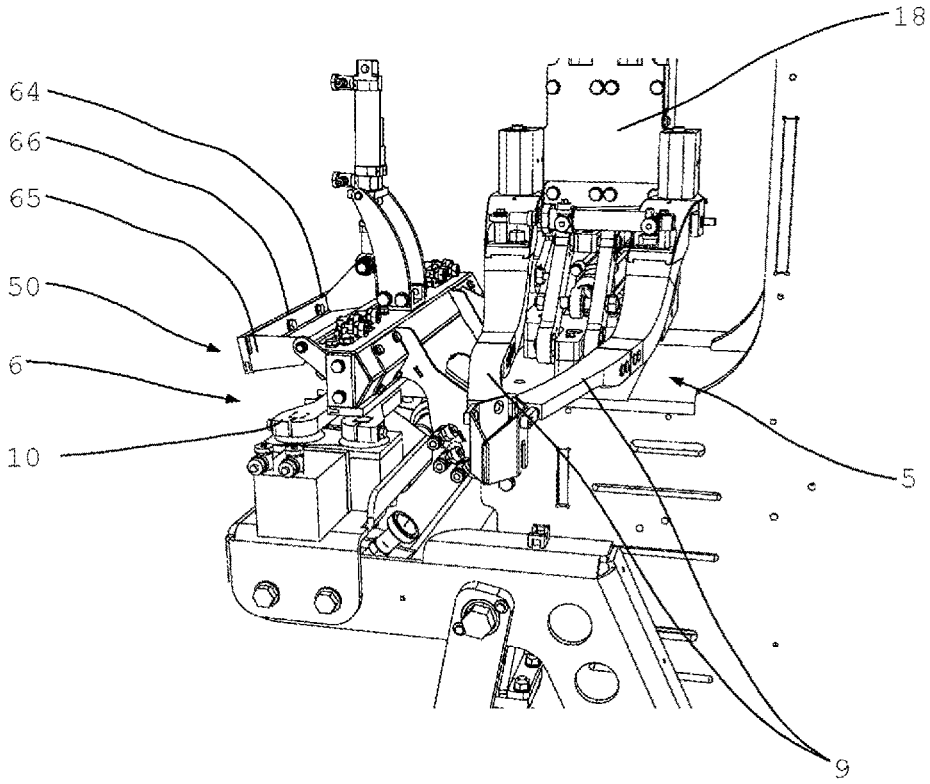
FIG. 14 shows an enlargement according to FIG. 13.

FIGS. 13 and 14 show the transfer device 4 or the base body 18 of the transfer device 4 of the packing machine 1 in an overview diagram and a detailed view.

The first gripper device 5 and the second gripper device 6 are arranged in this exemplary embodiment offset by 90° on the different sides 7, 8. As a result of this arrangement a superimposed operating mode of the empty bag and the full bag transfer or transport is ensured.

A cleaning device 50 is provided above the second gripper device 6, which comprises a housing device 64, wherein in the exemplary embodiment shown here a pivotable housing element 65 or a pivotable flap 66 is provided. The cleaning device 50 is explained in more detail in subsequent figures.

In addition, it can be seen that the first gripper device 5 is arranged on the side 7 of the base body 18, which, in the exemplary embodiment shown here, comprises two gripper arms 9, which can be moved here relative to each other or pivoted outwards or moved. Thus, the gripper arms act as spreaders and can pick up an empty bag from bag supply 2 or take it from this.

Furthermore, as can already be seen previously in the figures, the first gripper device 5 is provided to be pivotable so that this can be displaced forwards in the direction of the filling nozzle 101 and also in the direction of the bag supply 2. Depending on the configuration, for example, telescopic gripper arms 9 or other components of the first gripper device 5 can be provided.

Figure 15:
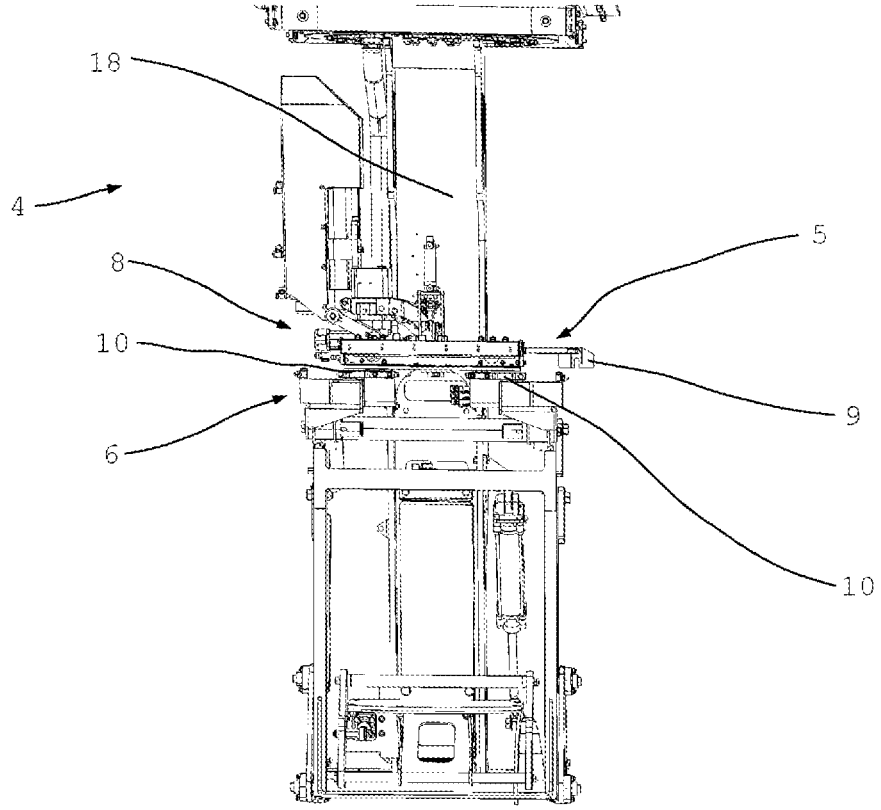
FIG. 15 shows a further purely schematic diagram of an exemplary embodiment of a transfer device.
Figure 16:
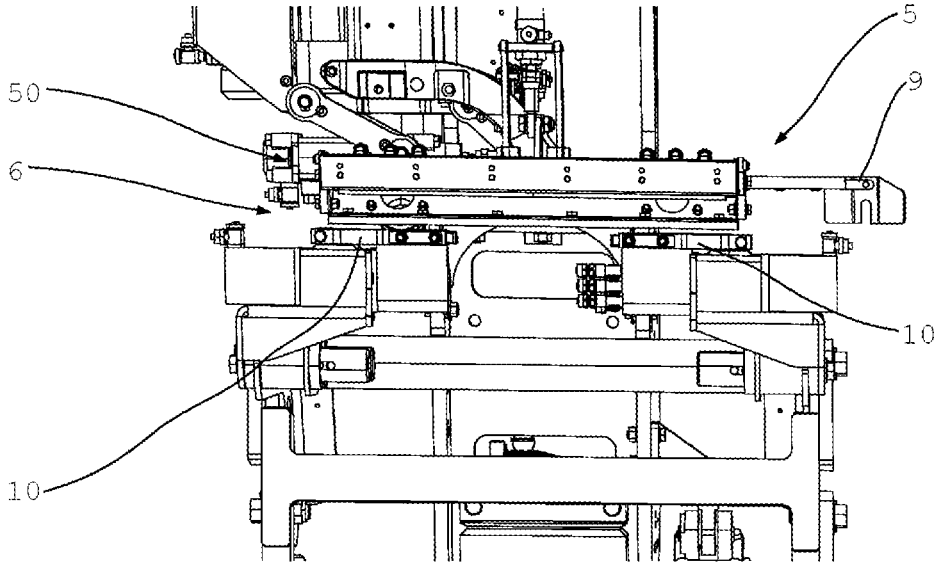
FIG. 16 shows an enlargement according to FIG. 15.

In FIGS. 15 and 16, the base body of the transfer device 4 is rotated in such a manner that the first gripper device 5 is aligned in the direction of the filling nozzle 101 of the filling module 100. In this position, an open bag not shown is held on the gripper arms 9 in the exemplary embodiment shown here by spreading the two gripper arms 9, wherein the gripper device 5 is displaced forwards to attach the bag which is held open to the filling nozzle 101. In addition, the second gripper device 6 with the clamping devices 10 can be identified.

Figure 17:
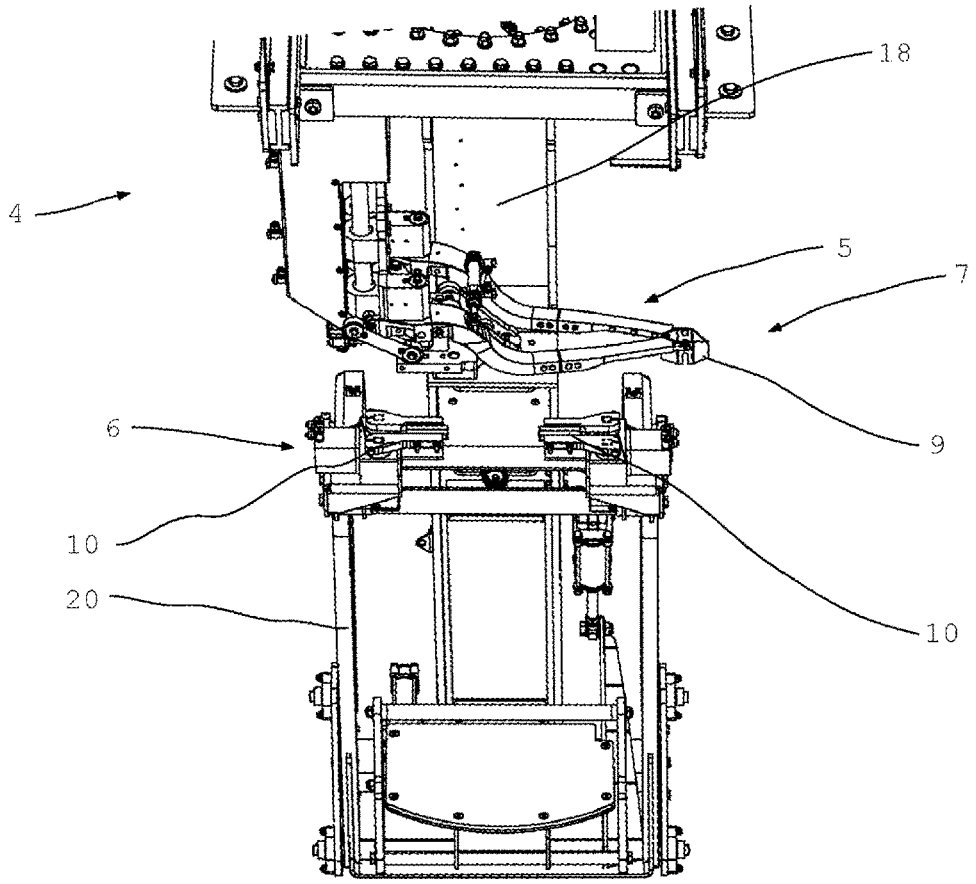
FIG. 17 shows a perspective view according to the view from FIG. 15.
Figure 18:
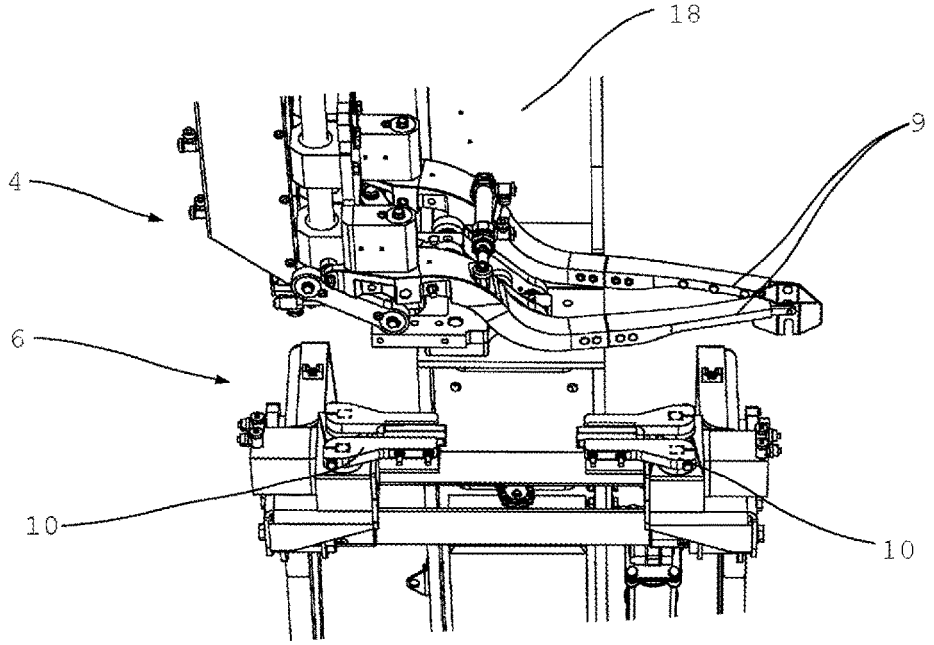
FIG. 18 shows an enlargement according to FIG. 17.

FIGS. 17 and 18 show the side view from FIGS. 15 and 16 again in a slightly perspective view from obliquely above, wherein in addition the cleaning device 50 above the second gripper device 6 is hidden in order to get a better impression of the clamping devices 10 of the second gripper device 6.

In FIGS. 19 to 24, the cleaning device 50 according to the invention provided above the second gripper device 6 in the exemplary embodiment shown here and its mode of operation is described in detail.

In this case, the cleaning device 50 according to the invention in the exemplary embodiment shown here is provided for cleaning the so-called head seam area of a bag to be closed by means of blown out air.

In addition to the application of the cleaning device 50 presented here, this can also clean any other work section, in particular in relation to the packing machine 1 described here.

Figure 19:
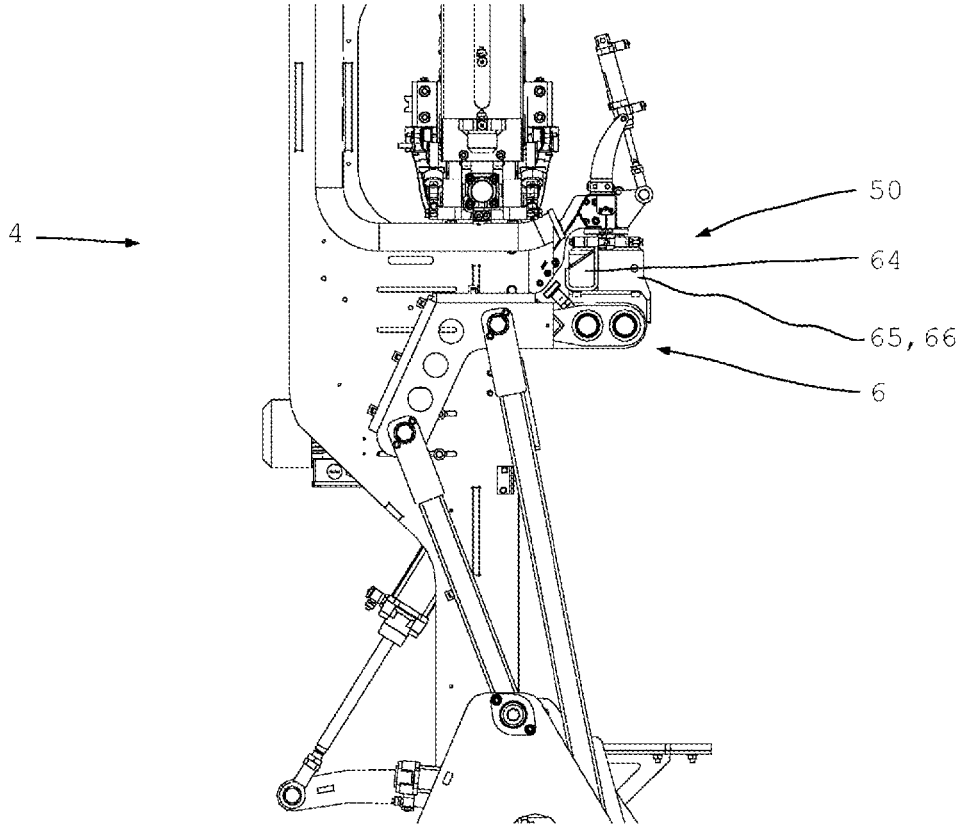
FIG. 19 shows a purely schematic view of an exemplary embodiment of a transfer device with a cleaning device according to the invention.

FIG. 19 shows an overview view of the transfer device 4 of the packing machine 1 according to the invention purely schematically, wherein in the exemplary embodiment shown here the cleaning device 50 according to the invention is arranged above the second gripper device 6.

In this exemplary embodiment, the cleaning device 50 comprises two blowing strips 51 which cannot be seen in FIG. 19. The cleaning device 50 is provided encapsulated in the exemplary embodiment shown here namely in a housing device 64. This makes it possible to achieve a hermetic sealing of the blowing strips 51 and the work section to be cleaned. In order to feed the work section to be cleaned or the bag to the cleaning device 50, the housing device 64 comprises a movable or, in this case, pivotable housing element 65 or a flap 66, which is shown in the closed state in the view shown.

Figure 20:
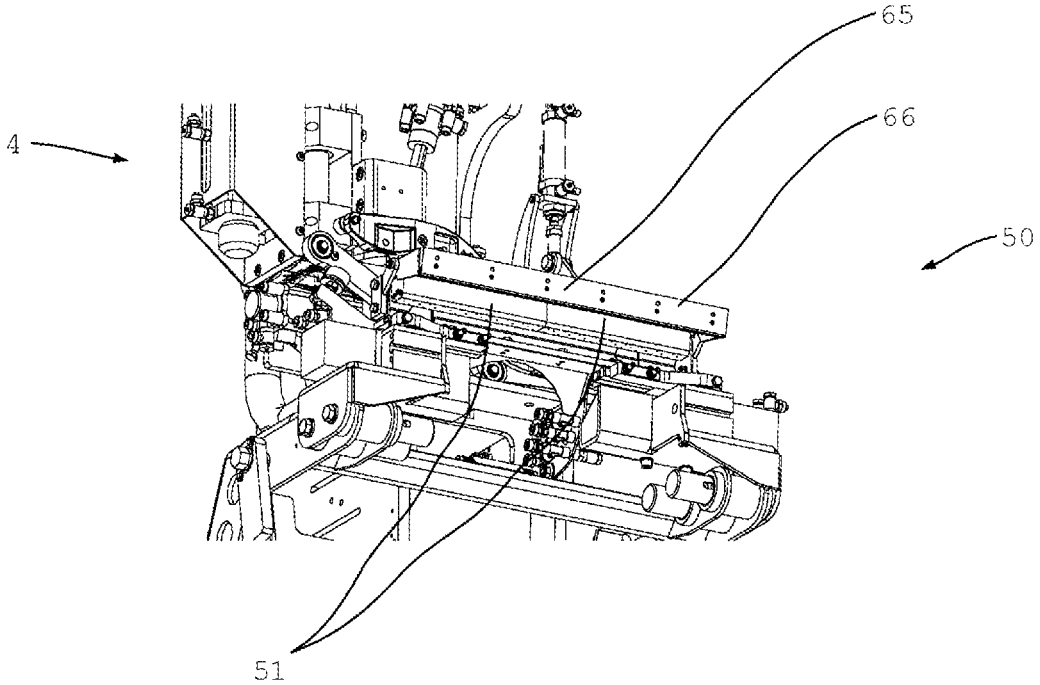
FIG. 20 shows a purely schematic diagram of a cleaning device according to the invention in a perspective view.

FIG. 20 shows in a perspective view a cleaning device according to the invention 50, wherein the movable housing element 65 or the flap 66 is shown in the open state. Thus, the view of the two blowing strips 51 located inside the housing device 64, shown here as an example, is free.

Figure 21:
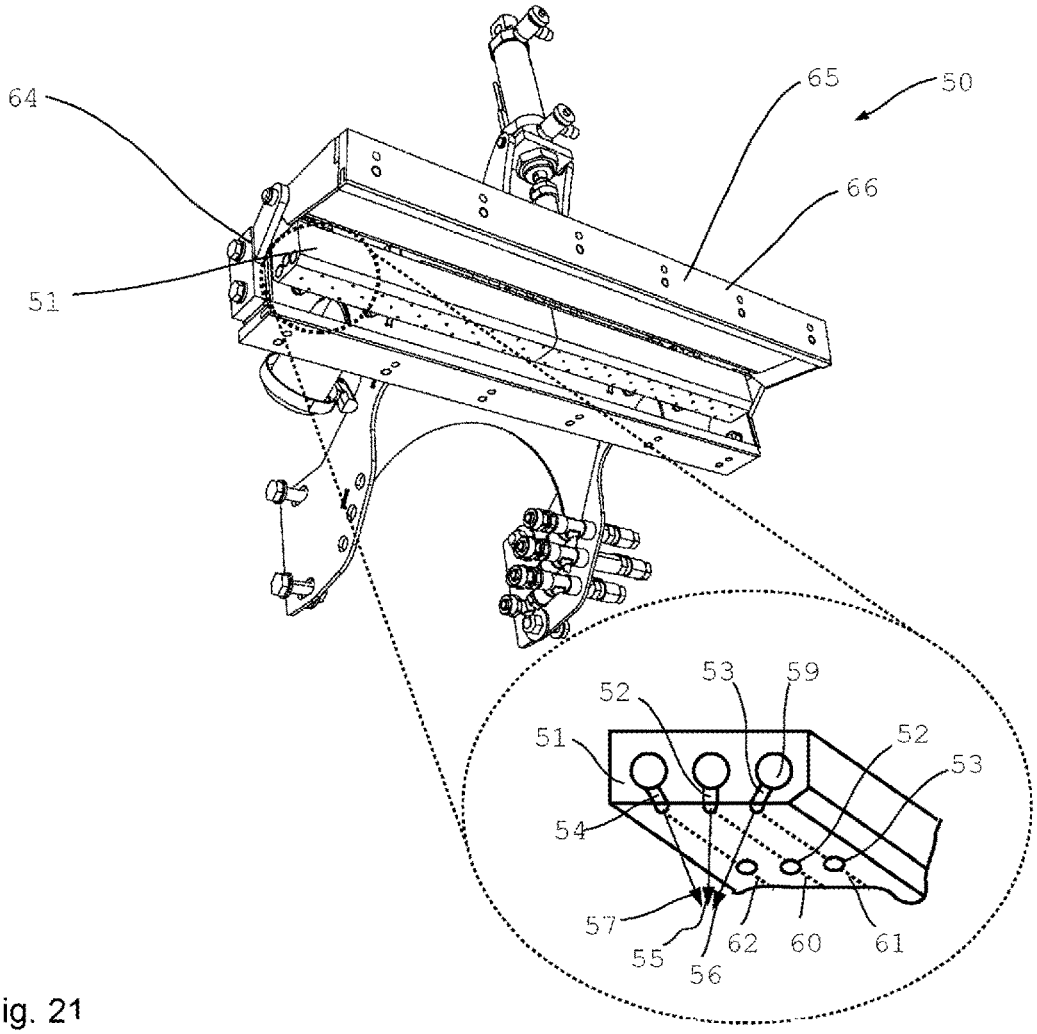
FIG. 21 shows a further purely schematic diagram of a cleaning device according to the invention in a perspective view.
Figure 22:
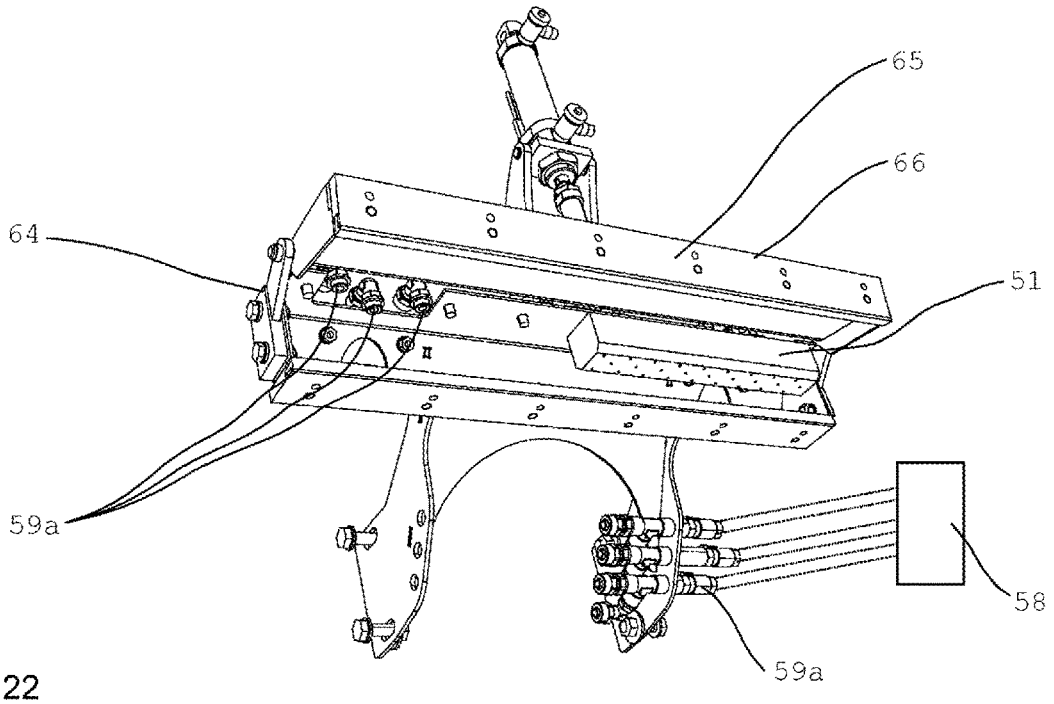
FIG. 22 shows a next purely schematic diagram of a cleaning device according to the invention in a perspective view.

In FIG. 21 in a perspective view, the assembly of the cleaning device 50 is shown separately in a perspective view. Here also, the flap 66 or the pivotable housing element 65 is shown in the open state, so that the two blowing strips 51 provided in the exemplary embodiment shown here can be seen.

In the exemplary embodiment shown here, the blowing strips 51 each comprise a plurality of first nozzle devices 52, second nozzle devices 53 and third nozzle devices 54, which are arranged here in rows 60, 61, 62.

In this case, the three rows 60, 61, 62 of the first nozzle devices 52, the second nozzle devices 53 and the third nozzle devices 54 can be supplied differently with air so that a moving air wave is blown out over the work section to be cleaned.

This is achieved whereby the first nozzle devices 52 or the first row 60 of first nozzle devices 52 each have a first blowing-out direction 55, which differs from the blowing-out directions 56, 57 of the other nozzle devices 53, 54 or rows 61, 62 of nozzle devices 53, 54. In particular, it is preferred and also provided in this exemplary embodiment that the first nozzle devices 52, the second nozzle devices 53 and the third nozzle devices 54 each have a blowing-out direction 50, 56, 57, which each differ from one another.

In this case, it is indicated in FIG. 21 that in the exemplary embodiment the blowing-out directions 55, 56, 57 or the individual air streams or fluid streams meet at a point 70 or a focal point. It is also feasible that the air streams meet on an imaginary focal line which is formed by the upper bag edge or lies just below it. This is the case when the nozzle devices of one row are offset with respect to the nozzle devices of another row. By this means, it can be achieved that as a result of the temporally staggered control of the individual nozzle devices 52, 53, 54, for example, when filling film bags, the area of the subsequent bag seam or head seam is effectively cleaned. The film layers lying on top of one another after filling which are then welded together, are blown apart or opened by the different air streams of the nozzle devices 52, 53, 54 so that the area between the film layers is also cleaned. Thus, a particularly good welding of the bag layers without weak points caused by contaminants such as the product to be filled can be achieved.

Furthermore, a control device 58 not shown in more detail in the figures is provided, which is suitable and configured to control the nozzle devices 52, 53, 54 at least at times in a temporally staggered manner For this purpose, it is provided in the exemplary embodiment shown that for the three rows 60, 61, 62 of nozzle devices 52, 53, 54 separate air supplies 59 are provided in each case within the blowing strips 51. This is provided here for both blowing strips 51 and can be identified in FIG. 22 purely schematically by hiding the left blowing strip 51. By hiding the one blowing strip 51 the separate air supplies 59*a* or the connections for the air supplies 59 of the blowing strip 51 located outside the blowing strip 51 can be seen.

Figure 23:
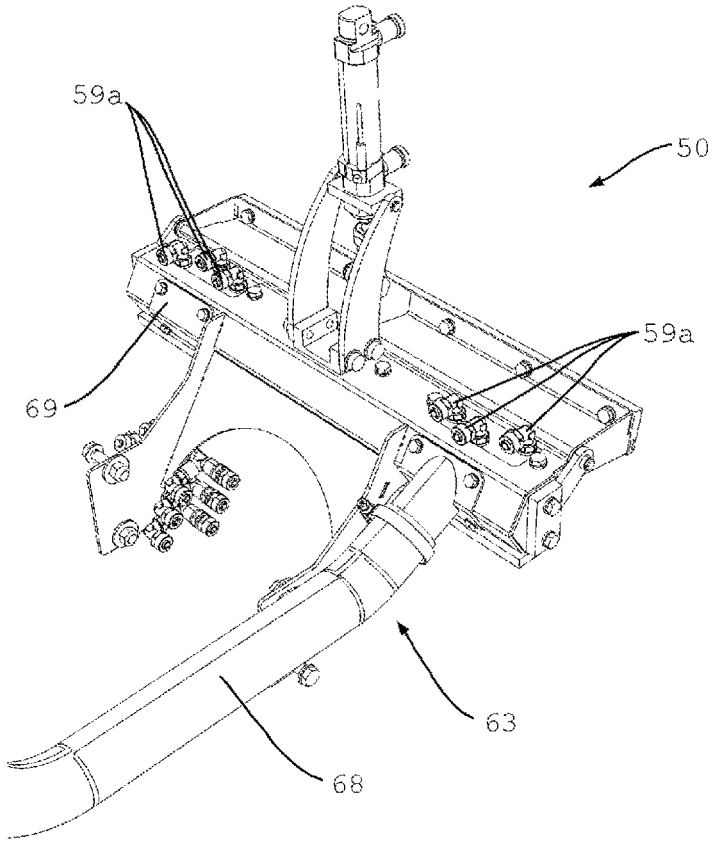
FIG. 23 shows another purely schematic diagram of a cleaning device according to the invention in a perspective view.
Figure 24:
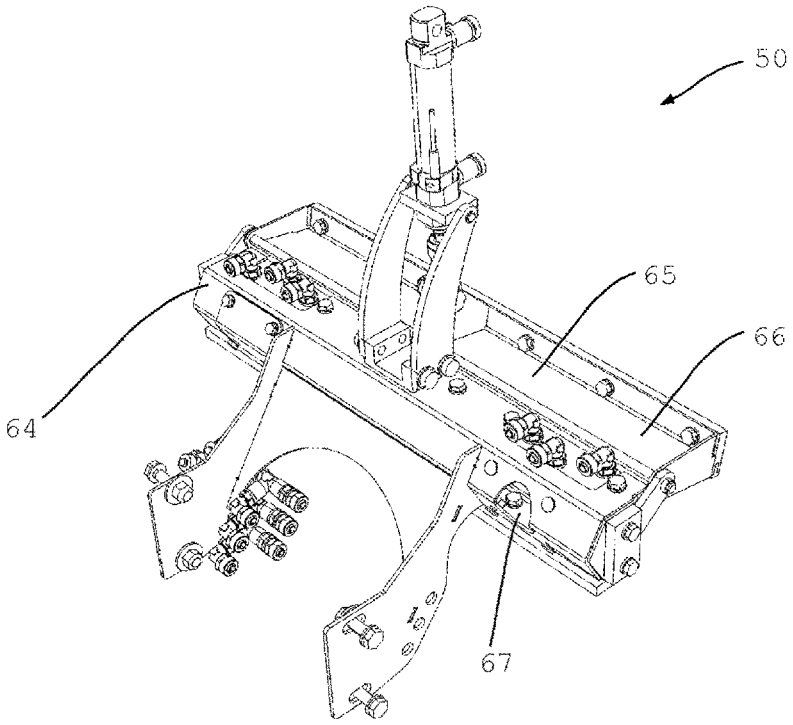
FIG. 24 shows a further purely schematic diagram of a cleaning device according to the invention in a perspective view.
Figure 25:
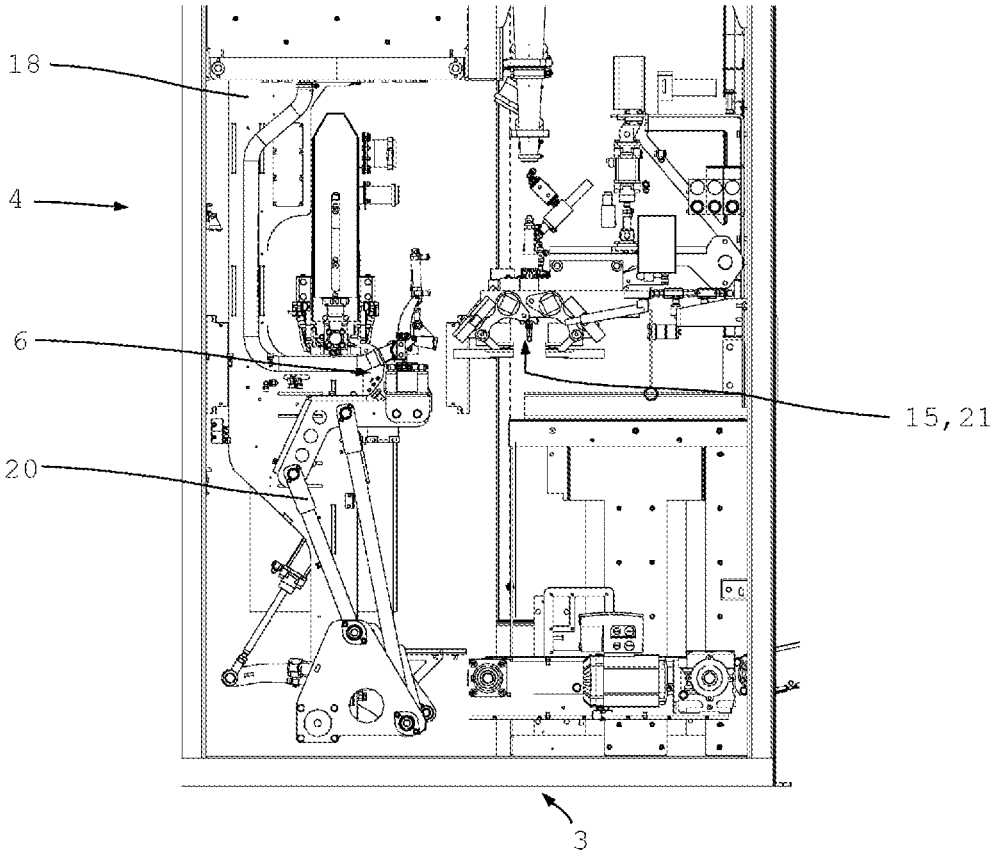
FIG. 25 shows a purely schematic diagram of an exemplary embodiment of a transfer device and a bag removal in a front view.
Figure 26:
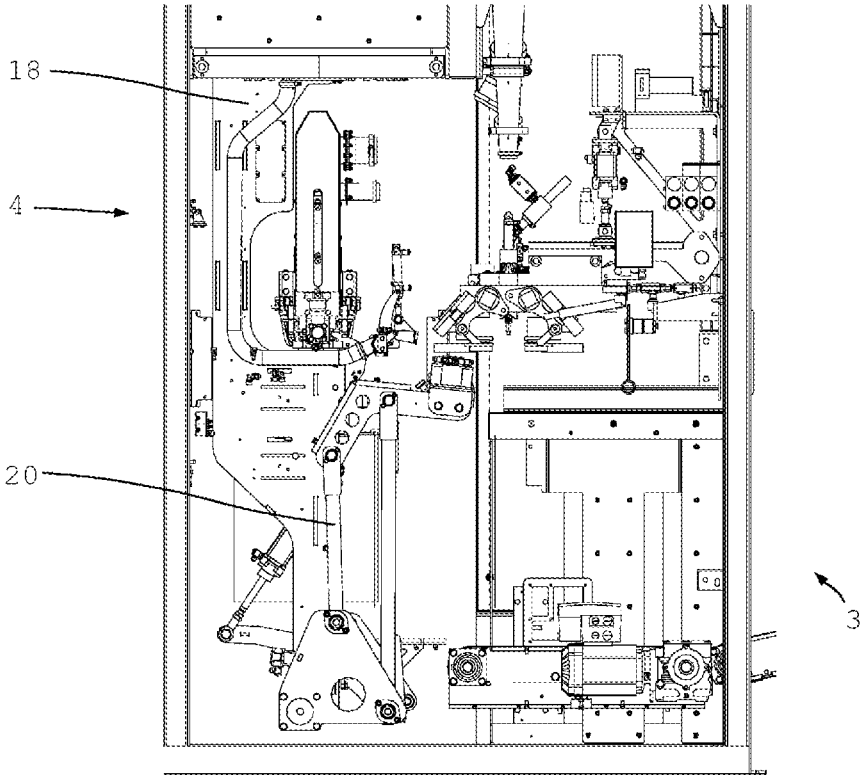
FIG. 26 shows a further purely schematic diagram of an exemplary embodiment of a transfer device and a bag removal in a front view.
Figure 27:
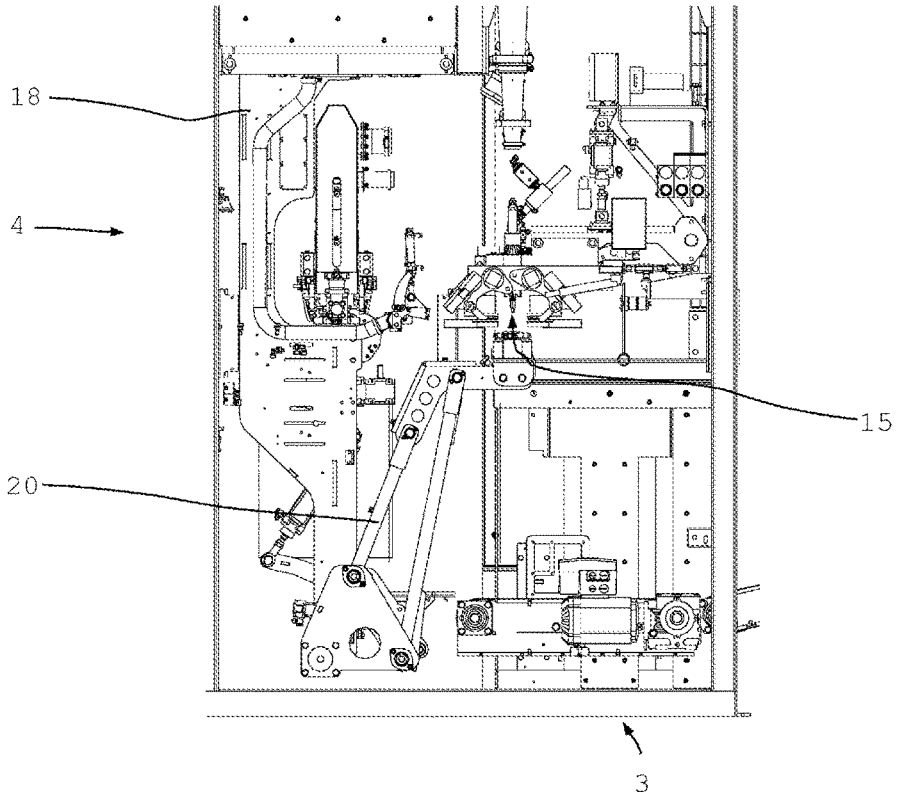
FIG. 27 shows a next purely schematic diagram of an exemplary embodiment of a transfer device and a bag removal in a front view.

FIGS. 23 and 24 show purely schematically that an extraction device 63 can also be provided to extract the air expelled by the blowing strips 51 or another fluid together with the swirled particles.

For this purpose, in the exemplary embodiment shown here the extraction device 63 is in operative connection with the interior of the housing device 64 via an opening 67 in the housing device 64.

In the exemplary embodiment shown, a suction pipe 68 is provided, which is connected to this opening 67. Depending on the configuration, for example, a further suction pipe 68 can be provided on the left side, wherein here the opening 67 is closed on the left side by a cover 69.

In the exemplary embodiment shown, as has already been described previously, it is provided that a hermetically substantially sealed cleaning space is created by closing the movable housing element 65 or the flap 66 of the housing device 64. Depending on the application, the extraction device is then set so that at least the air volume or generally the volume which is blown into the housing 64 through the blowing strips 51 is extracted. In particular, it is preferred that at least so much is extracted that at least a small vacuum is created inside the housing device 64. This is particularly important for systems that are used in dust explosion areas. In non-critical working environments or in general, a non-hermetically closing housing device 64 or even no housing device 64 can be provided.

In FIGS. 23 and 24 it can also be seen once again that the different rows 60, 61, 62 of the first, second and third nozzle devices 52, 53, 54 are connected via different air supply lines 59*a* per blowing strip 51.

Thus, the different control of the individual nozzle devices 52, 53, 54 or the individual rows 60, 61, 62 of these nozzle devices 52, 53, 54 is also possible differently per blowing strip 51. Thus, in the exemplary embodiment shown, an air wave or a moving air stream can be generated over the entire length and also over the width of the work section to be cleaned, whereby in particular the outlet pattern of a pendulum nozzle is modelled without using moving parts. In this case, in the blow-out pattern of a pendulum nozzle it is achieved that when cleaning the bag section for the subsequent head seam, the bag walls to be joined subsequently are blown apart so that product located between the bag walls is removed.

In particular, by means of an oscillating air jet it is achieved that when cleaning the bag mouth edge before closing or welding the filled bag by the moving air flow, the bag walls or film layers located on top of one another are opened by the acting air jet, so that the air jet impinges upon the inner surfaces, whereby the adhering dust or dirt particles are removed here. By changing the air jet, the layers of the side folds are also separated from each other with a corresponding design of the bag, so that this area is also cleaned. The individual film layers are as it were opened one after the other by the moving or oscillating air flow and cleaned by the air flow thus penetrating.

In FIGS. 25 to 28, the transfer of a filled bag by the transfer device 4 to the bag removal 3 is shown purely schematically.

In this case, a parallelogram-like structure 20 is provided, on which the second gripper device 6 with the clamping devices 10 is provided. This structure 20 is also used to remove the full bag from the filling nozzle 101 or to bring the second gripper device 6 into contact with the filled bag.

In the basic state, the second gripper device 6 abuts relatively closely against the base body 18 of the transfer device 4. In the following FIGS. 26 and 27 it can be seen how the second gripper device 6 moves forward in the direction of the bag removal 3 by displacing the parallelogram-like structure 20.

In this case, the closure device 15 can also be seen here, which is configured as a welding station 21 in the exemplary embodiment shown here.

Figure 28:
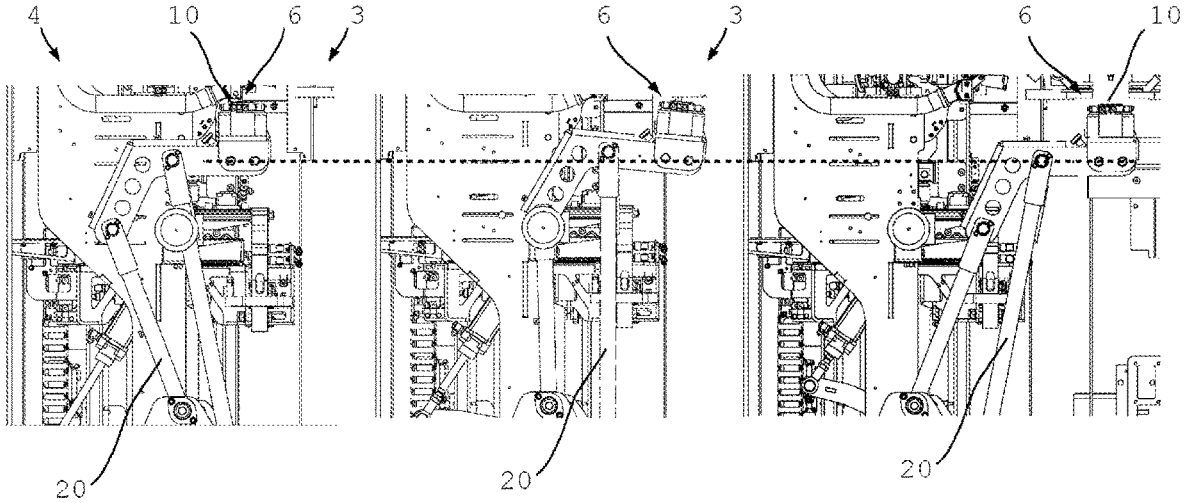
FIG. 28 shows sections from FIGS. 26, 27 and 28.
Figure 29:
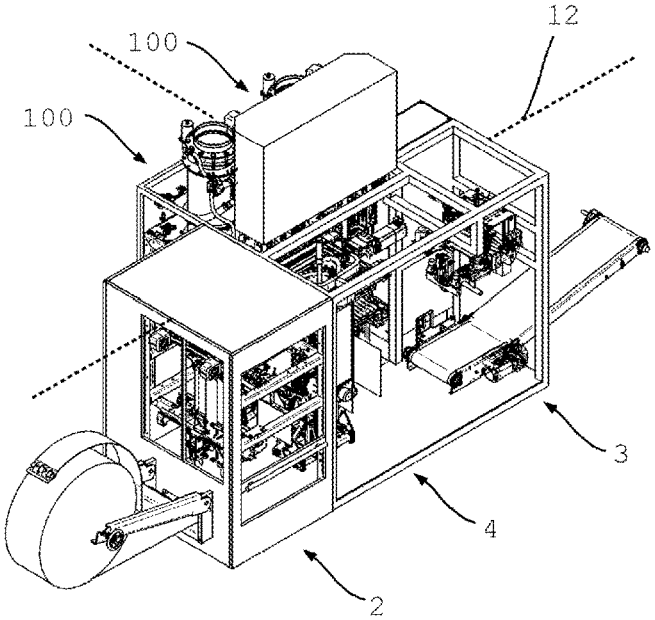
FIG. 29 shows a next exemplary embodiment of a packing machine according to the invention in a perspective view.
Figure 30:
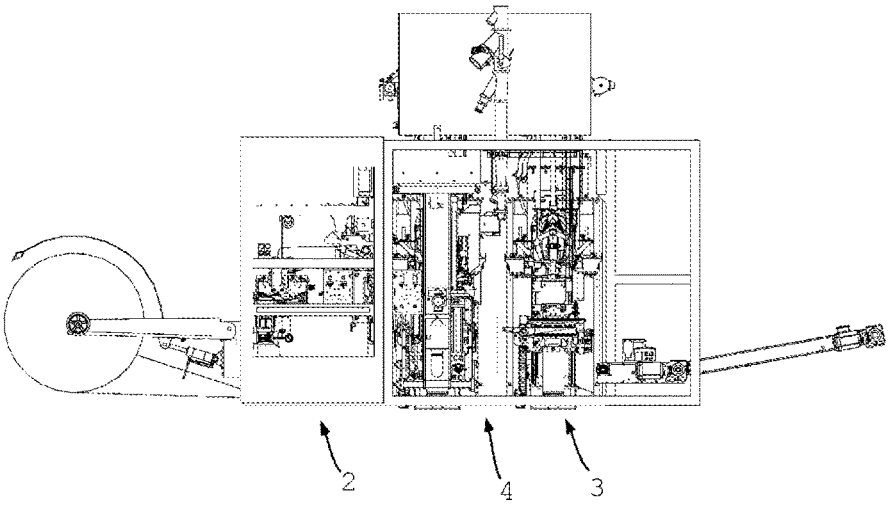
FIG. 30 shows the exemplary embodiment according to FIG. 29 in a front view.
Figure 31:
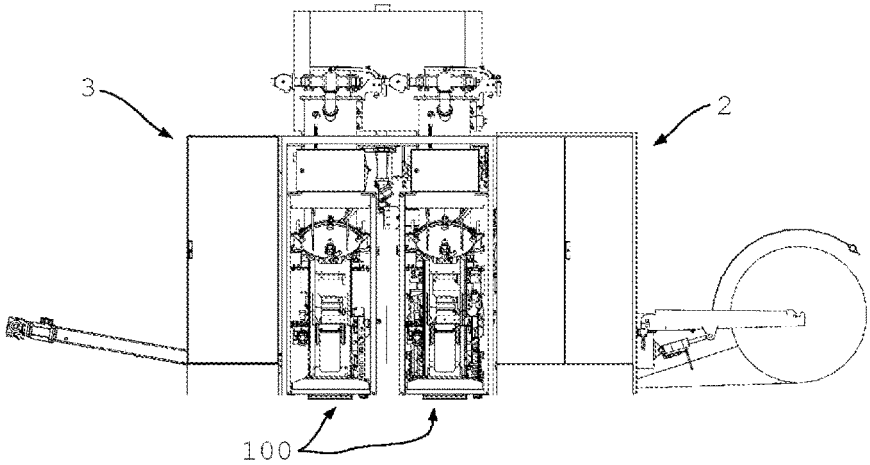
FIG. 31 shows the exemplary embodiment according to FIG. 29 in a rear view.
Figure 32:
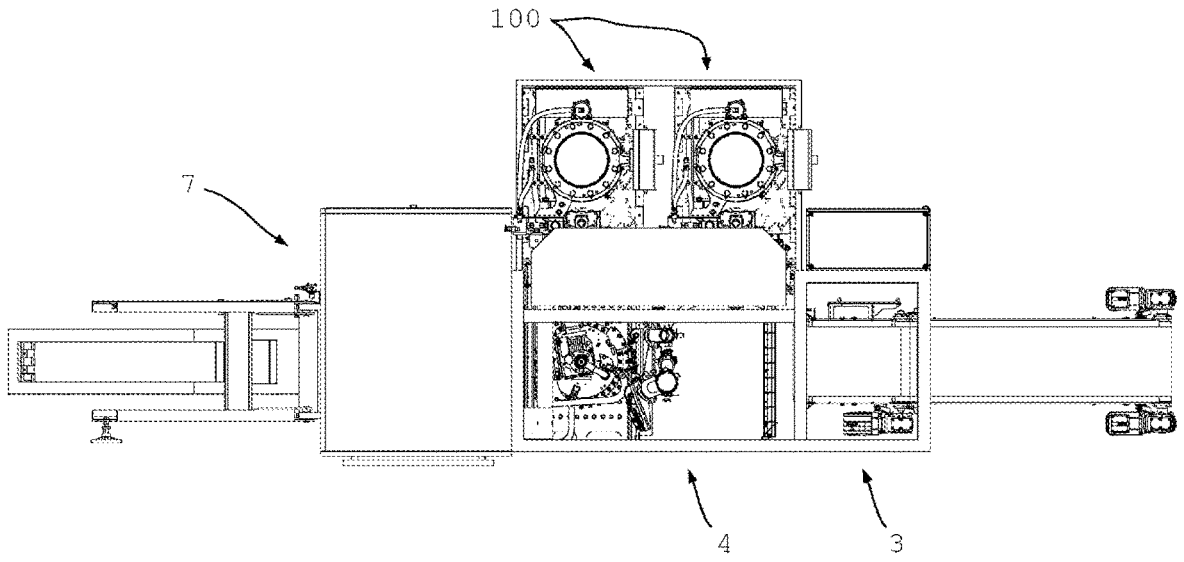
FIG. 32 shows the exemplary embodiment according to FIG. 29 in a plan view.
Figure 33:
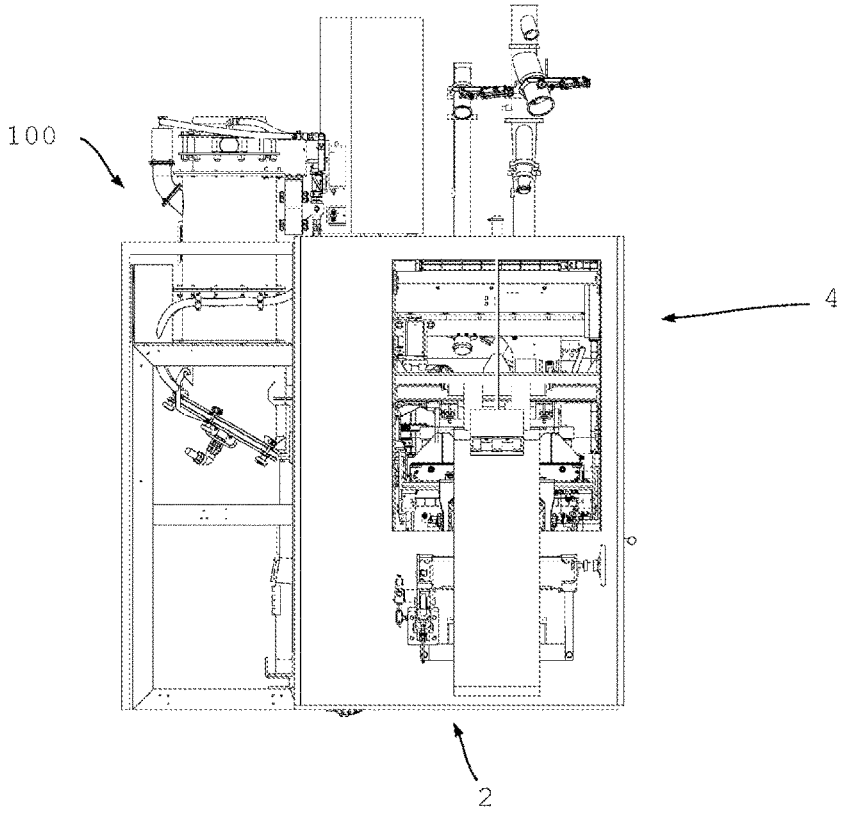
FIG. 33 shows the exemplary embodiment according to FIG. 29 in a side view.

FIG. 28 shows purely schematically by the side-by-side representation of the individual positions of the parallelogram-like structure 20 that due to the special configuration of this parallelogram-like structure 20, the filled bag is transferred by means of gripper device 6 of the transfer device 4 approximately on a line or approximately rectilinearly to the bag removal 3.

FIGS. 29 to 33 show a further exemplary embodiment of a packing machine 1 according to the invention. In this case, the configuration of this exemplary embodiment substantially corresponds to the exemplary embodiment already described.

In particular, the bag supply 2, the transfer device 4 and the bag removal 3 are arranged in a line 12. In contrast to the exemplary embodiment shown previously, not just one filling module 100 is pulled out of the line 12 and arranged next to the transfer device 4 but two filling modules 100 are arranged side by side outside the line 12.

In order to select which of the two filling modules 100 is used, in the exemplary embodiment shown here the transfer device 4 is provided to be movable so that this can be arranged either in front of one or the other filling module 100. For example, a quick product change or maintenance of a filling module 100 can be carried out, for which the transfer device 4 can be pushed or moved in front of the filling module 100 to be used or not to be maintained.

At the same time as the transfer device 4 can be displaced in the line 12, depending on the configuration, a movability or a displaceability of the transfer device 4 transverse to the line 12 can also be provided as in the exemplary embodiments shown previously.

In order to ensure a reliable picking up of bags from the bag supply 2 and a reliable delivery of the filled bags by the transfer device 4 to the bag removal 3, the individual components of the transfer device 4 can accordingly be provided to be displaceable.

Depending on the configuration, however, the bag supply 2 and/or the bag removal 3 can also be co-displaced so that there are always optimal distances between the individual assemblies.

While particular embodiments of the present cleaning apparatus and method for cleaning have been described herein, it will be appreciated by those skilled in the art that changes and modifications may be made thereto without departing from the invention in its broader aspects and as set forth in the following claims.

| Reference list | |
|---|---|
| 1 | Packing machine |
| 2 | Bag supply |
| 3 | Bag removal |
| 4 | Transfer device |
| 5 | First gripper device |
| 6 | Second gripper device |
| 7 | Side |
| 8 | Side |
| 9 | Gripper arm |
| 10 | Clamping device |
| 11 | Housing device |
| 12 | Line |
| 13 | Bag production |
| 14 | Film supply |
| 15 | Closure device |
| 16 | Conveyor belt |
| 17 | Housing cover |
| 18 | Base body |
| 19 | Rail |
| 20 | Parallelogram-like structure |
| 21 | Welding station |
| 50 | Cleaning apparatus |
| 51 | Blowing strip |
| 52 | First nozzle device |
| 53 | Second nozzle device |
| 54 | Third nozzle device |
| 55 | Blowing-out direction |
| 56 | Blowing-out direction |
| 57 | Blowing-out direction |
| 58 | Control device |
| 59 | Air supply |
| 59a | Air supply |
| 60 | Row |
| 61 | Row |
| 62 | Row |
| 63 | Suction device |
| 64 | Housing device |
| 65 | Housing element |
| 66 | Flap |
| 67 | Opening |
| 68 | Suction pipe |
| 69 | Cover |
| 70 | Point |
| 100 | Filling module |
| 101 | Filling nozzle |
| 102 | Housing device |
| 103 | Housing cover |
| 104 | Inlet hopper |
| 105 | Air filling module |
| 106 | Pressure chamber |

The invention claimed is:

1. A cleaning apparatus for cleaning a working section when filling bulk materials into bags, in particular for cleaning the area of a subsequent bag seam, comprising: at least one blowing strip having at least one first nozzle device; and at least one second nozzle device through which at least one air stream can be guided temporarily in each case;

the first nozzle device has a fixed blowing-out direction and that the second nozzle device has a fixed blowing-out direction, wherein the blowing-out directions of the first nozzle device and of the second nozzle device differ from one another;

and that at least one control device is provided which is suitable and configured to control the at least one first nozzle device and the at least one second nozzle device at least temporarily in a temporally staggered manner.

2. The cleaning apparatus according to claim 1, wherein at least two first nozzle devices and at least two second nozzle devices are provided, wherein at least one first nozzle device and at least one second nozzle device is controllable at least temporarily in a temporally staggered manner.

3. The cleaning apparatus according to claim 1, wherein the first nozzle device and the second nozzle device have separate and/or common air supplies.

4. The cleaning apparatus according to claim 1, wherein the first nozzle device and the second nozzle device have a common air supply, wherein the first and/or the second nozzle device comprise at least one closure element in order to control the air stream that can be guided through the nozzle devices in a temporally staggered manner.

5. The cleaning apparatus according to claim 1, wherein at least a third nozzle device is provided which has a fixed blowing-out direction, wherein the blowing-out directions of the first nozzle device, the second nozzle device and/or the third nozzle device differ from one another.

6. The cleaning apparatus according to claim 1, wherein at least two blowing-out directions intersect in a point or a line.

7. The cleaning apparatus according to claim 1, wherein in each case a plurality of first, second, third and/or further nozzle devices are provided which in each case are arranged in rows on the blowing strip.

8. The cleaning apparatus according to claim 7, wherein nozzle devices from different rows are supplied with air via a common air supply.

9. The cleaning apparatus according to claim 8, wherein the row of the first nozzle devices is arranged centrally between the rows of second nozzle devices and third nozzle devices, wherein the blowing-out direction of the first nozzle devices is aligned substantially vertically downwards and wherein the rows of the second and third nozzle devices are arranged on opposite sides of the first nozzle devices and wherein the blowing-out direction of the second and third nozzle devices is inclined in each case at least slightly in the direction of the first nozzle devices.

10. The cleaning apparatus according to claim 7, wherein the nozzle devices of at least one row of nozzle devices are arranged offset with respect to at least one other row of nozzle devices.

11. The cleaning apparatus according to claim 1, wherein at least two blowing strips are provided which are arranged adjacent to one another.

12. The cleaning apparatus according to claim 11, wherein the nozzle devices of the individual blowing strips are controllable differently.

13. The cleaning apparatus according to claim 1, wherein at least one suction device is provided.

14. The cleaning apparatus according to claim 13, wherein the suction device is in operative connection with the housing device.

15. The cleaning apparatus according to claim 1, wherein at least one housing device is provided.

16. The cleaning apparatus according to claim 15, wherein the housing device comprises at least one housing element which is pivotable at least in sections.

17. The cleaning apparatus according to claim 1, wherein the length of the blowing strip is adapted to the length of a working section to be cleaned.

18. A packing machine for filling product and in particular bulk products into bags comprising at least one cleaning apparatus according to claim 1.

19. A method for cleaning a working section when filling bulk materials into bags, in particular for cleaning the area of a subsequent bag seam using a cleaning apparatus according to claim 1, wherein, the control device controls the first nozzle device and the second nozzle device in a temporally offset manner.

20. The method according to claim 19, wherein a suction device is operated at least temporarily.

21. The method according to claim 20, wherein the blowing strip is arranged in a housing device and the suction device extracts at least temporarily and at least in sections inside the housing device.

22. The method according to claim 19, wherein the nozzle devices are arranged in several rows and/or that several blowing strips are arranged in a row and that the control device supplies the nozzle devices with air in such a manner that a wave-like air stream emerges along the working area to be cleaned.

* * * * *